US005977940A

United States Patent [19]

Akiyama et al.

[11] Patent Number: 5,977,940

[45] Date of Patent: Nov. 2, 1999

[54] LIQUID CRYSTAL DISPLAY DEVICE

[75] Inventors: Masahiko Akiyama, Tokyo; Tsuyoshi Hioki; Tomonobu Motai, both of Yokohama; Goh Itoh, Tokyo; Haruhiko Okumura, Fujisawa, all of Japan

[73] Assignee: Kabushiki Kaisha Toshiba, Japan

[21] Appl. No.: 08/812,738

[22] Filed: Mar. 6, 1997

[30] Foreign Application Priority Data

Mar. 7, 1996 [JP] Japan ..... 8-050623

[51] Int. Cl.[6] ..... G09G 3/36

[52] U.S. Cl. ..... 345/94; 345/205; 345/90; 345/92

[58] Field of Search ..... 345/92, 94, 96, 345/147, 89, 148, 100, 90, 205, 206, 98, 211; 348/674, 792; 349/159

[56] References Cited

U.S. PATENT DOCUMENTS

| | | | |
|---|---|---|---|
| 4,514,727 | 4/1985 | Van Antwerp | 345/148 |
| 5,091,722 | 2/1992 | Kitajima et al. | 345/89 |
| 5,206,633 | 4/1993 | Zalph | 345/92 |
| 5,339,090 | 8/1994 | Crossland et al. | 345/90 |
| 5,396,351 | 3/1995 | Gessel | 349/159 |
| 5,430,460 | 7/1995 | Takabatake et al. | 345/96 |
| 5,528,256 | 6/1996 | Erhart et al. | 345/96 |
| 5,600,345 | 2/1997 | Dingwall et al. | 345/100 |
| 5,646,643 | 7/1997 | Hirai et al. | 345/100 |
| 5,684,501 | 11/1997 | Knapp et al. | 345/94 |
| 5,686,932 | 11/1997 | Tomita | 345/94 |

OTHER PUBLICATIONS

A. Juliana et al.; "Thin–Film Polysilicon Devices for Flat–Panel Display Circuitry", SID 82 Digest, pp. 38–39, May 11, 1992.

*Primary Examiner*—Xiao Wu
*Assistant Examiner*—Francis Nguyen
*Attorney, Agent, or Firm*—Finnegan, Henderson, Farabow, Garrett & Dunner, L.L.P.

[57] ABSTRACT

Each pixel of a liquid crystal display device comprises a switching device for selecting a data signal, a memory portion for storing the data signal selected by the switching device and outputting an analog signal corresponding to the data signal, and a circuit for supplying an AC voltage corresponding to the analog signal to the liquid crystal layer. The liquid crystal layer is driven with a data signal stored in the memory portion or with an AC voltage corresponding to an analog signal corresponding to the data signal. With the signal stored in the memory portion, an AC voltage whose effective value or average value is controlled is supplied to the liquid crystal layer. Thus, unless a picture on the display is changed, since it is not necessary to supply the data signal, the peripheral driving circuit can be stopped. Consequently, although a picture is displayed in gradation mode, the power consumption can be remarkably reduced.

7 Claims, 15 Drawing Sheets

VR
VT
VCS
Sm+1
Sm
Gn
Gn+1
TIMING LINE
Vref
Vp
VLC
VCOM
COMPAR-ATOR
Q
S
T
R
V1
V1'
V2
VCS1
VCS2
CS1
CS2
CS
1
2
3
4
4b
5
6
7
8
9
10
11
12
13
14
15

1FRAME(=1/60sec)

VCOM

Vg

Vsig
t

V1'
t
FLY-BACK INTERVAL
SIGNAL WRITE INTERVAL
VT

SIGNAL OF CURRENT FRAME
SIGNAL OF PRECEDING FRAME

V1
t

Fig.4
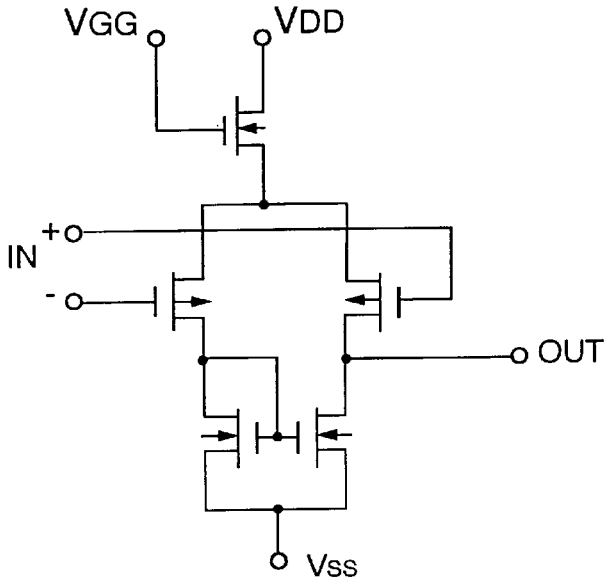
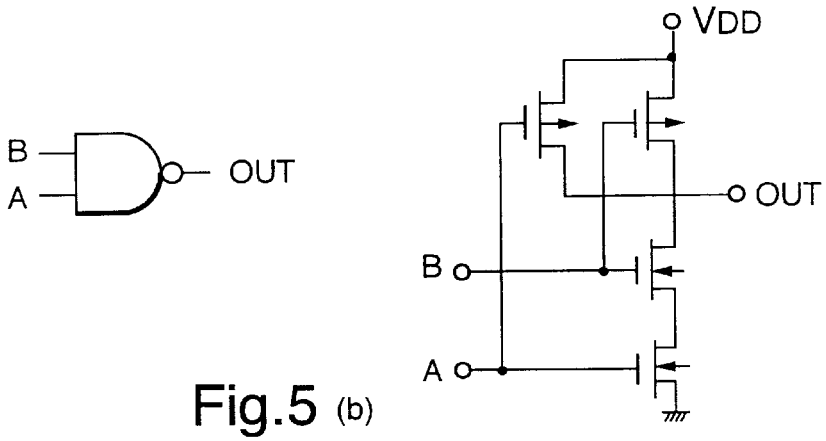
Fig.5 (b)
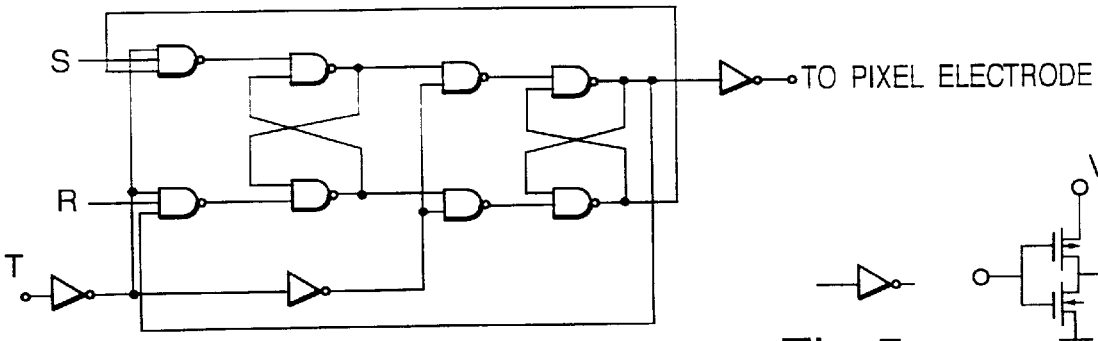
Fig.5 (a)
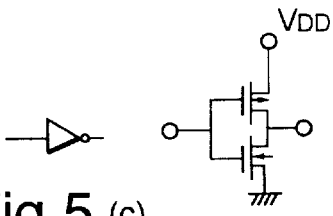
Fig.5 (c)

LIQUID CRYSTAL DISPLAY DEVICE

BACKGROUND OF THE INVENTION

1. Field of the Invention

The present invention relates to a liquid crystal display device, in particular to, an active matrix type liquid crystal display device. In addition, the present invention relates to a liquid crystal display device that can display gradation.

2. Description of the Related Art

The present invention relates to a liquid crystal display device, in particular to, a liquid crystal display device of less power consumption type. In addition, the present invention relates to a liquid crystal display device that can display gradation.

Since a liquid crystal display is thin and the power consumption thereof is small, it has been widely used for note type personal computers. In particular, an excellent feature of the liquid crystal display device over other types of display devices such as CRT and plasma display is low power consumption. The liquid crystal display device is expected to be used for portable information units.

In the case of a portable unit, the power consumption of the display thereof is preferably 500 mW or less, more preferably several mW or less. For such a requirement, so far, a reflection type liquid crystal display device of simple matrix and small power consumption type free of a back light with a TN (Twisted Nematic) liquid crystal has been used. However, since the TN type liquid crystal requires a polarized plate, the reflectance is around as low as around 30%. In addition, when the number of pixels of the simple matrix type liquid crystal display is increased, the contrast decreases and thereby the display picture quality deteriorates. To solve such a problem, a PCGH (Phase Change Guest Host type) mode liquid crystal that does not need a polarized plate is used. Moreover, with an active matrix, a display device with high reflection rate and high contrast has been developed.

FIG. 10 is a schematic diagram showing a circuit diagram showing the structure of a pixel of such a conventional liquid crystal display device. In the following, unless required, only one pixel will be described for simplicity. The structure of the circuit of a pixel shown in FIG. 10 is the same as the structure of a conventional transmission active matrix type liquid crystal display device. When a thin film transistor 91 is turned on corresponding to a scanning signal supplied to a gate line 94, the voltage of a data signal supplied to a signal line 95 is supplied to a liquid crystal layer 93. In addition, an electric charge is supplied to an auxiliary capacitor 92 through an auxiliary capacitor line (Cs) line 97. As well known, an AC voltage should be supplied to the liquid crystal layer 93. A voltage of a data signal that varies based on a voltage of an opposite electrode 96 formed on an opposite substrate is supplied to the signal line 95 so as to drive the pixel.

In such a liquid crystal display device, even if a picture displayed on the display does not change at all, it is necessary to supply an AC voltage to the liquid crystal layer. Thus, whenever the pixel is selected at a frame interval, the pixel voltage is rewritten. Since the power consumption P of which an AC voltage is supplied to the capacitor is expressed by the following formula.

$$p=f\times V^2\times C$$

where f=frequency; V=voltage; and C=capacitance.

Thus, the power consumption is proportional to each of the frequency, voltage, and capacitance.

When a liquid crystal display device is driven with an AC voltage, the drive frequency of each pixel is represented with a frame frequency. The drive frequency of the signal line is represented with the product of the frame frequency and the number of scanning lines. The drive frequency of a signal line driver IC is represented with the product of the number of pixels of the display and the frame frequency. When the liquid crystal display is separately driven, the drive frequency of the signal line driver IC is represented with the quotient of which the product of the number of pixels of the display and the frame frequency is divided by the number of separated regions. For example, in the case of a VGA type liquid crystal display device composed of 640×480 pixels (RGB), assuming that the frame frequency is 60 Hz and that each of RGB uses respective shift registers, the clock frequency of the signal line driver IC becomes 60×480×640 =18 MHz. Although the power consumption of the liquid crystal display device partly depends on the driving IC, the power consumption becomes around 200 mW. The frequency of each signal line becomes 60×480=29 kHz. Assuming that the diagonal length of the liquid crystal display device is 10.4 inches, the capacitance of each signal line is around 40 pF. When the display panel of the liquid crystal display device is driven, the power consumption becomes around 50 mW. When the number of pixels is increased (for example the display panel is composed of 1600×1200 pixels), since the power consumption thereof is proportional to the number of gate lines, the power consumption of this display panel becomes 2.5 times as large as that of the conventional display panel composed of 640×480 pixels. In addition, since the power consumption of the driver IC is increased with the similar rate, the total power consumption of the apparatus increases to around 1 W. When a portable information unit has a liquid crystal display device with a large power consumption, the battery of the unit runs out in a short time. Thus, the operation time of the unit becomes short. To prolong the operation time of the unit, a large (heavy) battery should be used.

To reduce the power consumption, a surface stabilized ferroelectric liquid crystal (SSFLC) can be used. The SSFLC has a memory characteristic. Thus, unless a picture displayed on the display is changed, the voltage supply can be stopped. However, in the SSFLC, the orientation of the liquid crystal becomes disordered with a shock and thereby a picture is not correctly displayed. Thus, the SSFLC cannot be used for a portable display device. In addition, a liquid crystal with a memory characteristic occasionally has restrictions with respect to contrast and reflection rate. Thus, the display quality of such a liquid crystal has a problem of the display quality. For example, the SSFLC requires a polarizing plate. In addition, since the reflection rate of the SSFLC is as low as around 30%, a picture on the display becomes the brightness decreases. Moreover, due to the characteristic of the SSFLC, since a picture is basically displayed in binary display mode rather than gradation display mode, the display characteristic (information amount) of the SSFLC is much lower than that of the apparatus with the gradation display mode. This is a notable drawback of the SSFLC when it displays color pictures. To display gradation, if a space modulation corresponding to for example dither method is used, the effective resolution is deteriorated. When a time modulation corresponding to frame rate control method is performed, a picture on the display flickers. Thus, the SSFLC cannot be used for moving pictures.

As described above, personal computers and portable information units mostly deal with still pictures. Thus, even if a picture is not changed, an AC voltage is supplied to a signal line. Thus, the power is wasted.

An object of the present invention is to solve the above-described problem and to provide a liquid crystal display device of less power consumption type.

Another object of the present invention is to provide a liquid crystal display device for allowing a gradation signal to be supplied to a liquid crystal so as to display data greater than binary data.

SUMMARY OF THE INVENTION

To solve the above-described problem, the present invention has the following structures.

A first aspect of the present invention is a liquid crystal display device, comprising a liquid crystal layer interposed between a first electrode and a second electrode, a selecting means for selecting a data signal, a storing means for storing the data signal selected by the selecting means and outputting an analog signal corresponding to the data signal, and a voltage supplying means for supplying an AC voltage corresponding to the analog signal to the liquid crystal layer.

According to the present invention, while an AC voltage is supplied to a liquid crystal, when a picture is not required to be changed, a voltage supply to a signal line can be stopped. Thus, while the power consumption is decreased, an analog signal can be supplied as an effective voltage or average voltage (that is the average value of the absolute value of the voltage supplied to the liquid crystal layer) to the liquid crystal layer.

The first electrode is for example an opposite electrode. The second electrode is for example a pixel electrode. It should be noted that the first electrode and the second electrode may be a pixel electrode and an opposite electrode, respectively. The data signal may be an analog signal or a digital signal. The selecting means is for example a non-linear switching device such as a TFT (Thin Film Transistor) or MIM (Metal Insulator Metal). In addition, the selecting means may be composed of a combination of such switching devices. When the source and drain of a thin film transistor that is turned on and off corresponding to respective scanning signals are connected, any pixel of the pixel array can be selectively driven. This structure can be applied for the case that a still picture is displayed on the screen of the liquid crystal display device and a moving picture is displayed in a window of the still picture.

The storing means stores the data signal selected by the selecting means and outputs a DC analog signal corresponding to the data signal. The storing means may include a first storing means for storing the data signal selected by the selecting means and outputting the analog signal corresponding to the data signal and second storing means for storing the analog signal received from the first storing means and outputting the analog signal to the voltage supplying means. According to the liquid crystal display device of the present invention with such a structure, a data signal is temporarily stored in the storing means so as to delay it. Thereafter, the data signal is supplied to the second voltage supplying means. Thus, when a picture is changed, the picture on the screen can be prevented from becoming disordered. For example, after data signals for one screen are stored in all the pixels that compose the display screen are stored, the data signals can be supplied to the second voltage supplying means at a time. Thus, when a moving picture is displayed, the moving picture on the screen is prevented from becoming disordered. The storing means may comprise "a first converting means for converting a data signal into a digital signal, a storing means for storing the resultant digital data signal, and a second converting means for converting the digital data signal stored in the storing means into an analog signal".

For example, the first storing means and the second storing means are storage capacitor elements with capacitances corresponding to the data signal.

In addition, a switching device may be intervened between the first storing means and the second storing means so as to control the timing for sending the data signal from the first storing means to the second storing means.

With such a structure of the storing means, a data signal sampled corresponding to a selection signal can be supplied to the voltage supplying means at another timing. For example, the storing means stores the data signal selected by the selecting means at a first timing and outputs the data signal to the second voltage supplying means at a second timing with a predetermined delay against the first timing. Thus, the data signals for one screen are stored in all the pixels that composes the display screen. Consequently, when a picture is changed or a moving picture is displayed, the picture on the screen is prevented from becoming disordered.

The storage capacitor element may be a ferroelectric capacitor with a ferroelectric substance rather than a paraelectric substance with a paraelectric substance. Since a data signal stored in a ferroelectric substance is stably held until the polarization state of the ferroelectric substance is varied, an analog signal corresponding to the data signal can be stably supplied to the voltage supplying means.

As another mode of the storing means, a digital memory such as a semiconductor memory that stores digital data can be used. When the data signal is a digital signal or when an analog data signal is converted into digital data by an analog-digital converter (ADC) or the like and stored, the digital memory can be used.

When the data signal is digitally stored, it can be supplied to the voltage supplying means free of fluctuation of electric characteristics of selecting means and storage capacitor element and influence of noise.

The voltage supplying means supplies an AC voltage corresponding to the analog data signal received from the storing means to the liquid crystal layer so as to drive the liquid crystal layer.

For example, the voltage supplying means having a first voltage supplying means for supplying a first AC voltage, a second voltage supplying means for supplying a second AC voltage with a phase difference against the first AC voltage corresponding to the analog signal, and a voltage difference between the first AC voltage and the second AC voltage is applied to the liquid crystal layer. The voltage difference between the first AC voltage and the second AC voltage is applied to the liquid crystal layer via the first electrode, the second electrode or the first and the second electrode.

For example, the voltage supplying means may include a first voltage supplying means for supplying a first AC voltage to the first electrode and a second voltage supplying means for supplying a second AC voltage with a phase difference against the first AC voltage corresponding to the data signal to the second electrode.

In this case, the storing means may store the data signal selected by the selecting means at a first timing and outputs the data signal to the second voltage supplying means at a second timing with a predetermined delay against the first timing.

As a real example, the liquid crystal display device further comprises a means for supplying a reference signal that periodically varies, wherein the second voltage supplying means compares the analog signal with the reference voltage and supplies a second AC voltage to the second electrode, the second AC voltage having a phase difference corresponding to time after the beginning of the period of the variation of the reference voltage until the analog signal accords with the reference voltage. To generate a second AC voltage with such a phase difference, a voltage comparator that compares for example a ramp shaped or stair-step shaped reference voltage with the analog voltage received from the storing means and outputs a high level voltage or low level voltage depending on the compared result may be used. In addition, it is possible to employ a waveform shaper which shapes a profile of the output of the voltage comparator.

With the voltage supplying means having such a structure, a first AC voltage is supplied to one electrode disposed on the liquid crystal, whereas a second AC voltage is supplied to the other electrode disposed thereon. Thus, the voltage supplied to the liquid crystal layer are pulse-modulated corresponding to an analog signal received from the storing means. The effective value or average value (the average values of the absolute values) of the AC voltage supplied to the liquid crystal layer can be controlled corresponding to the data signal. In other words, in the liquid crystal display device according to the present invention, an AC voltage is generated corresponding to a data signal stored in each pixel so as to drive the liquid crystal layer. Thus, unless a picture on the display is changed, it is not necessary to supply a data signal to the pixel. Consequently, the power consumption can be remarkably reduced. In addition, when a picture is not changed, each pixel can display gradation.

In the above-described voltage supplying means, the first AC voltage is supplied to one electrode disposed on the liquid crystal layer. The second AC voltage with a phase difference corresponding to the analog signal received from the storing means against the first AC voltage is supplied to the other electrode formed on the liquid crystal layer. Thus, the effective value or average value of the AC voltage supplied to the liquid crystal layer is controlled. However, the voltage supplying means of the liquid crystal display device according to the present invention is not limited to such a structure. In the above-described voltage supplying means, AC voltages are supplied to both the first electrode and the second electrode. With the phase difference of the AC voltages supplied to the first electrode and the second electrode, the effective value or average value of the AC voltage supplied to the liquid crystal layer is controlled. However, according to the voltage supplying means, a DC voltage with a constant level is supplied to one electrode (for example, an opposite electrode), whereas a second AC voltage corresponding to an analog signal is supplied to the other electrode (for example, a pixel electrode). Thus, the effective value or average value of the AC voltage supplied to the liquid crystal layer is controlled. Consequently, the power consumption can be further reduced. In addition, the structure of the driving circuit of the first electrode becomes simple, thereby reducing the fabrication cost of the liquid crystal display device.

As a real example of the voltage supplying means, the second voltage supplying means may include a means for inverting the polarity of the analog signal, the second voltage supplying means alternately supplying the analog signal and the inversion analog signal to the second electrode.

A second aspect of the present invention is a liquid crystal display device, comprising a liquid crystal layer interposed between a first electrode and a second electrode, a signal line for supplying an analog data signal, a first converting means for selecting the data signal on the signal line and converting the data signal into a digital data signal, a storing means for storing the data signal converted into the digital signal, a second converting means for converting the digital data signal stored in the storing means into an analog data signal, and a driving means for driving the liquid crystal layer corresponding to the analog data signal converted by the second converting means.

The second converting means may be a part of the driving means. In other words, a data signal may be supplied as a digital signal to the driving means. In this case, the driving means converts the data signal into an analog voltage and supplies the analog signal to the liquid crystal layer.

In the liquid crystal display device with such a structure, since a data signal is stored as a digital signal, the data signal can be supplied to the voltage supplying means free of fluctuation of electric characteristics of the selecting means and influence of noise.

As an example of the first converting means, a combination of the analog-digital converter (ADC) and the storing means of the first aspect may be used. As with the storing means of the first aspect, the storing means may store the data signal converted by the first converting means at a first timing and outputs the data signal at a second timing with a predetermined delay against the first timing to the driving means.

The structure of the driving means may be the same as the structure of the voltage supplying means of the first aspect. In other words, the driving means may include a first voltage supplying means for supplying a first AC voltage to the first electrode and a second voltage supplying means for supplying a second AC voltage to the second electrode, the second AC voltage having a phase difference corresponding to the data signal against the first AC voltage.

As a real example, the liquid crystal display device may further comprises a means for supplying a reference voltage (reference signal) that periodically varies, wherein the second voltage supplying means compares the data signal with the reference signal and supplies a second AC voltage to the second electrode, the second AC voltage having a phase difference corresponding to time after the beginning of the period of the variation of the reference voltage until the data signal accords with the reference signal.

To generate a second AC voltage with such a phase difference, a digital comparator that receives digital data that periodically increases and decreases as a reference signal, compares the value of the reference signal and the level of the DC voltage received from the storing means, and outputs a high level (low level) signal can be used. When a digital-analog decoder is disposed downstream of the comparator, an AC voltage corresponding to the decoded analog signal can be generated.

The method for generating the AC voltage corresponding to the data signal is not limited to the method for supplying two AC voltages with a phase difference to the two electrodes oppositely disposed with the liquid crystal layer. Instead, with a three-value comparator, an AC voltage can be generated. In the three-value comparator, the levels of two AC voltages is compared. If the difference of the levels is almost zero, a reference voltage (for example, a ground voltage) is output. If the difference of the levels is positive, a predetermined positive voltage (for example, $+V_0$) is output. If the difference of the levels is negative, a predetermined negative voltage ($-V_0$) is output. By supplying the output voltage of the three-value comparator to one electrode (for example, a pixel electrode) and a predetermined voltage to the other electrode (for example, an opposite electrode), an AC voltage corresponding to the data signal can be supplied to the liquid crystal layer. In addition, it is possible to employ an integral circuit which receives an output of the three-value comparator so that the waveform of the output voltage of the three-value comparator is smoothed, and the resultant voltage can be supplied to the liquid crystal layer.

As with the first aspect of the present invention, a constant DC voltage (including 0 V) can be supplied to the first electrode, whereas an AC voltage corresponding to the data signal can be supplied to the second electrode.

As an example of the structure of the driving means, the driving means may include a first voltage supplying means for supplying a DC voltage with a constant level to the first electrode and a second voltage supplying means for supplying the analog signal as an AC voltage corresponding to the analog signal to the second electrode. As a real example of the second voltage supplying means, the second voltage supplying means may include a means for inverting the polarity of the analog signal and alternately supplying the analog signal and the inversion analog signal to the second electrode.

According to the present invention, since a data signal stored in the storing means is a digital signal, data can be stored free of fluctuations of signals and characteristics of various circuits. Thus, the quality of a picture on the display can be improved.

In the liquid crystal display device according to the present invention, a digital signal may be supplied through a signal line. In other words, the liquid crystal display device may comprise a signal line for sending a data signal as an analog signal or a digital signal, a storing means for storing the data signal received from the signal line as a digital signal, a second converting means for converting the data signal stored in the storing means into an analog signal, and a driving means for driving a liquid crystal layer corresponding to the data signal as the analog signal.

A third aspect of the present invention is a liquid crystal display device, comprising a liquid crystal layer interposed between a first electrode and a second electrode, a selecting means for selecting a data signal, a means for outputting an analog signal corresponding to the data signal selected by the selecting means, and a voltage supplying means for supplying an AC voltage corresponding to the analog signal to the second electrode.

As described above, the voltage of the first electrode may be kept constant. The voltage supplying means may include a means for inverting the polarity of the analog signal, the voltage supplying means alternately supplying the analog signal and the inversion analog signal to the second electrode.

As an example of the structure of the liquid crystal display device according to the present invention, a data signal sampled by for example the selecting means is supplied to an analog buffer. An analog DC voltage that is received from the analog buffer and that just corresponds to the data signal is supplied to the liquid crystal layer in such a manner that the polarity of the analog DC voltage is inverted. When a storage capacitor element such as an auxiliary capacitor is disposed downstream of the selecting means, the level of the input voltage of the analog buffer can be held.

With such a structure, an AC voltage corresponding to the data signal can be generated in a pixel so as to drive the liquid crystal layer. In addition, the voltage of the opposite electrode can be kept at a constant voltage (for example, a ground voltage).

A fourth aspect of the present invention is a liquid crystal display device having pixels disposed in a matrix shape between a first electrode and a second electrode, comprising a means for selectively supplying a data signal to any pixel, a selecting means for selecting the data signal, a storing means for storing the data signal and outputting an analog signal corresponding to the data signal, and a driving means for driving the liquid crystal layer with a AC voltage corresponding to the analog signal.

In other words, the selecting means of each pixel can selectively sample a data signal supplied to any pixel. As an example of the selecting means, the selecting means may include a first scanning line for receiving a first scanning signal, a second scanning line for receiving a second scanning signal, a signal line for receiving the data signal, and a switching device, controlled corresponding to the first scanning signal and the second scanning signal, for selecting the data signal on the signal line when the switching device is turned on. Only when a plurality of switching devices that are turned on and off corresponding to different data signals are turned on, any pixel in a pixel array that composes the display screen can be selectively driven. In this case, a still picture is displayed on the display screen of the liquid crystal display device. This liquid crystal display device can be applied for the structure of which there is a window of a moving picture in a still picture. The fourth aspect of the present invention can be applied for any liquid crystal display devices according to the first to third aspect of the present invention.

These and other objects, features and advantages of the present invention will become more apparent in light of the following detailed description of best mode embodiments thereof, as illustrated in the accompanying drawings.

BRIEF DESCRIPTION OF THE DRAWINGS

FIG. 4 is a circuit diagram showing the structure of a voltage comparator 3;

FIGS. 5(*a*) to 5(*c*) show examples of logic circuit diagrams of a waveform shaper;

DESCRIPTION OF THE PREFERRED EMBODIMENTS (First Embodiment)

Figure 1A:
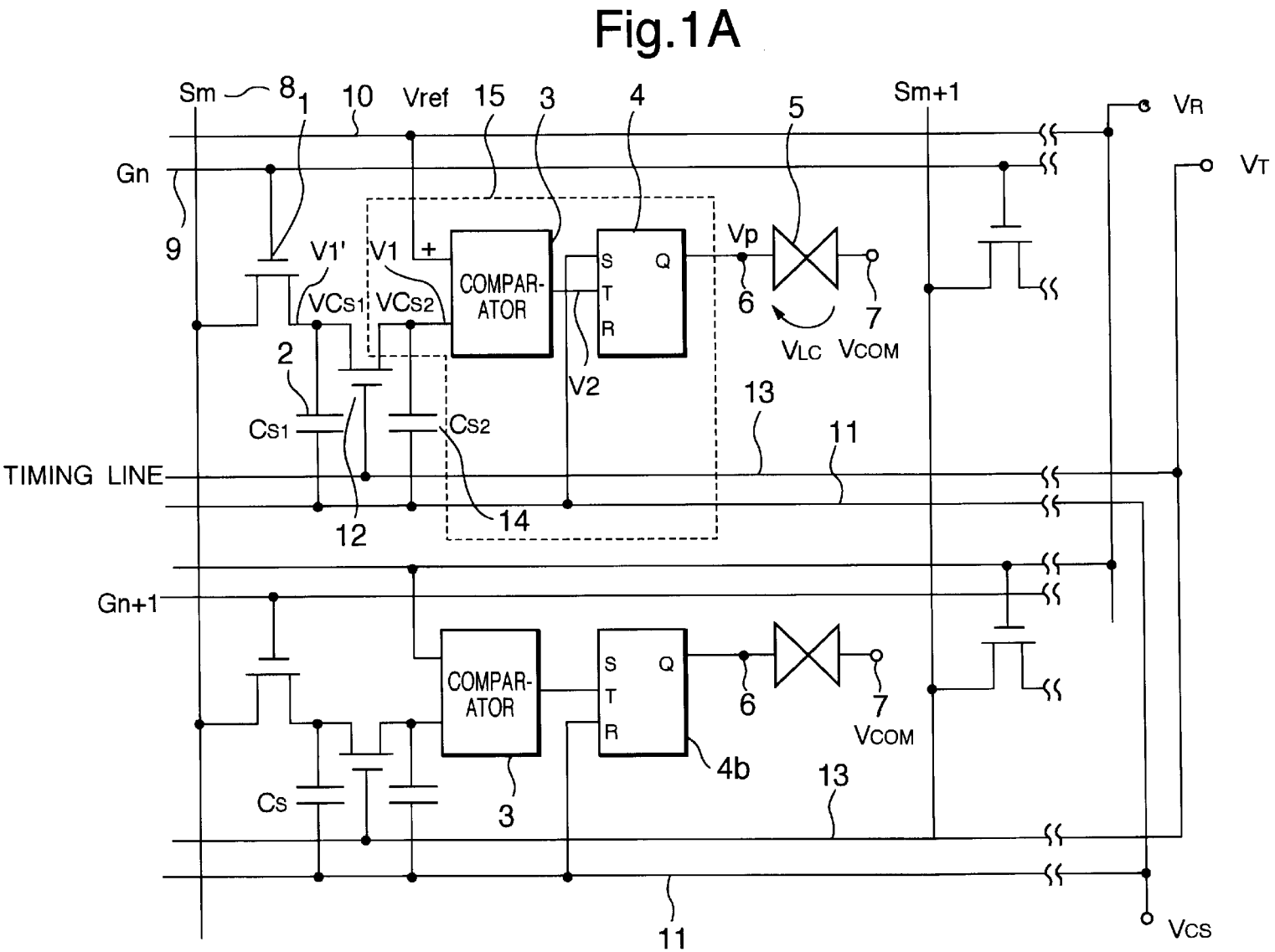
FIG. 1A is an equivalent circuit diagram showing the structure of a pixel of a liquid crystal display device according to the present invention.

FIG. 1A is an equivalent circuit diagram showing the structure of a pixel of a liquid crystal display device according to a first embodiment of the present invention.

The liquid crystal display device is of active matrix type. A liquid crystal layer is interposed between an array substrate and an opposite substrate. Pixel electrodes are formed in a matrix shape on the array substrate. An opposite electrode is formed on the opposite substrate. Each pixel unit of the array substrate has a pixel electrode and a drive device that drives the pixel electrode. Such pixels are disposed in a matrix array shape and thereby the intensity of incident light is two-dimensionally modulated. Thus, a picture is displayed.

Each pixel unit of the liquid crystal display device shown in FIG. 1A comprises a transistor 1, a storage capacitor (Csl) 2, a storage capacitor (Cs2) 14, a transistor 12, a voltage comparator 3, a waveform shaper 4, and a pixel electrode 6. The transistor 1 samples a data signal. The transistor 12 moves a voltage corresponding to a data signal from the storage capacitor (Csl) 2 to the storage capacitor (Cs2) 14. Next, the driving operation of the liquid crystal display device will be described.

A plurality of signal lines 8 that supply data signals and a plurality of gate lines 9 that supply scanning signals for controlling on/off states of the transistor 1 are disposed in such a manner that the signal lines 8 and the gate lines 9 are crossing with each other but insulated each other. A signal line and a gate line that are connected to a pixel at column m and line n of a pixel array of m×n matrix are denoted by Sm and Gn, respectively. The signal line 8 is connected to the source of the transistor 1. The gate line 9 is connected to the gate of the transistor 1. When the transistor 1 is turned on with a scanning signal, a data signal received from the signal line 8 is supplied to the pixel through the source and the drain of the transistor 1.

The storage capacitor (Csl) 2 is connected to the drain of the transistor 1. The storage capacitor (Csl) 2 is connected to the storage capacitor line (Cs line) 11. When the signal level of the gate line 9 becomes high and the transistor 1 is turned on (in the case that the transistor 1 is of n-channel type), the voltage of the data signal is stored in the storage capacitor 2. The voltage of the data signal stored in the storage capacitor 2 is denoted by V1'.

The storage capacitor 2 is connected to the source of the transistor 12. The drain of the transistor 12 is connected to the voltage comparator 3. The gate of the transistor 12 is connected to a timing line 13. The transistor 12 is turned on and off corresponding to a pulse supplied to the timing line 13. When the transistor 12 is turned on, the voltage V1' corresponding to the data signal stored in the storage capacitor 2 is held in the storage capacitor (Cs2) 14. The voltage held in the storage capacitor (Cs2) 14 is denoted by V1. Thus, the input voltage of the voltage comparator 3 is also V1. With the storage capacitor (Cs2) 14, the input voltage V1 of the voltage comparator 3 is maintained when the transistor 14 is turned off.

The other input terminal of the voltage comparator 3 is connected to a reference voltage line 10. A common voltage is preferably supplied to at least a plurality of pixels (normally, all pixels) through the reference voltage line 10. The voltage comparator 3 compares input voltages received from the two input terminals. When one of the input voltages becomes higher than the other, the voltage comparator 3 output a high level voltage. The output voltage of the voltage comparator 3 is referred to as V2. The output voltage of the voltage comparator 3 is supplied to the waveform shaper 4.

In this case, the waveform shaper 4 is a T type flip-flop. The waveform shaper 4 inverts the level of the output voltage corresponding to a leading edge of a pulse of the output voltage V2 received from the voltage comparator 3. The output voltage of the waveform shaper 4 is supplied to the pixel electrode 6.

The liquid crystal layer 5 is interposed between the array substrate and the opposite substrate. The pixel circuit is formed on the array substrate. The opposite electrode 7 is formed on the opposite substrate. A voltage $V_{LC}$ between the pixel electrode 6 and the opposite electrode 7 is supplied to the liquid crystal layer 5. The voltage of the opposite electrode 7 is denoted by $V_{COM}$.

Figure 2:
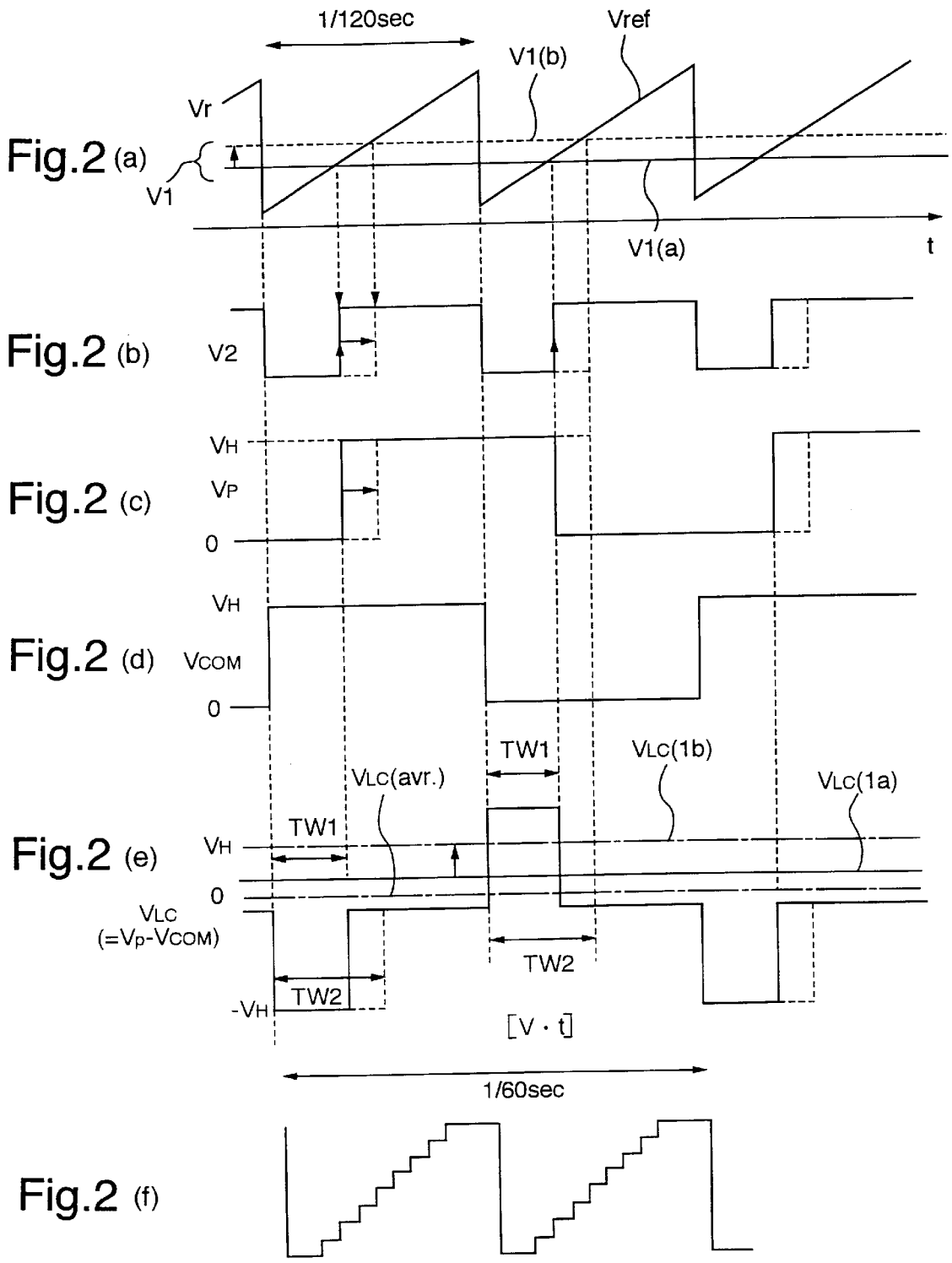
FIGS. 2(*a*) to 2(*f*) are profiles showing of applied signals for explaining a driving operation of the pixel of the liquid crystal display device according to the present invention shown in FIG. 1A.

FIGS. 2(*a*) to 2(*f*) are schematic diagrams for explaining a driving operation of a pixel with such a structure. FIG. 2(*a*) shows a profile of the voltage V1 supplied to the voltage comparator 3 and a profile of the reference voltage $V_{REF}$. FIG. 2(*b*) shows a profile of the output voltage V2 of the voltage comparator 3. FIG. 2(*c*) shows a profile of an output voltage $V_{pix}$ of the waveform shaper 4. FIG. 2(*d*) shows a profile of the voltage $V_{COM}$ supplied to the opposite electrode 7. FIG. 2(*e*) shows a profile of the voltage supplied to the liquid crystal layer 5. FIG. 2(*f*) shows another example of the profile of the reference voltage $V_{REF}$.

Now, assume that a still picture is displayed and that a data signal has been sampled and the input voltage of the voltage comparator 3 is V1.

As shown in FIG. 2(*a*), the reference voltage V supplied to the reference voltage line 10 is a ramp wave of 120 Hz. On the other hand, a square wave corresponding to the timing and period of the reference voltage $V_{REF}$ is supplied to the opposite electrode 7 (see FIG. 2(*d*)).

The output voltage of the voltage comparator 3 is obtained by comparing the reference voltage $V_{REF}$ and the voltage V1 of the storage capacitor. In other words, when the voltage of the reference line voltage $V_{REF}$ is lower than the voltage V1 of the storage capacitor, the level of the output voltage V2 of the voltage comparator 3 becomes low. When the voltage of the reference line voltage $V_{REF}$ becomes higher than the voltage V1 of the storage capacitor, the level of the output voltage V2 becomes high. Thus, the waveform of the output voltage of the voltage comparator 3 becomes the waveform shown in FIG. 2(*b*).

The level of the output voltage of the waveform shaper 4 is inverted corresponding to a leading edge of a pulse of the output voltage V2. Thus, the waveform of the output voltage $V_{pix}$ of the waveform shaper 4 becomes a square wave of which the phase of the reference voltage $V_{REF}$ is shifted as shown in FIG. 2(*c*). The output voltage $V_{pix}$ of the waveform shaper 4 is supplied to the pixel electrode 6 that is one electrode that holds the liquid crystal layer 5.

In this example, as shown in FIG. 2(*d*), the voltage $V_{COM}$ of the opposite electrode 7 is supplied as a square wave with almost the same phase as the reference voltage $V_{REF}$. Assuming that the wave height of each of the voltage Vpix of the pixel electrode and the voltage $V_{COM}$ of the opposite electrode is denoted by VH, the voltage $V_{LC}$ supplied to the liquid crystal layer 5 is given by the following formula.

$$V_{LC}=(Vpix-V_{COM})$$

The profile of the voltage $V_{LC}$ supplied to the liquid crystal layer 5 is a waveform with three values as shown in FIG. 2(*e*). The amplitude of the voltage $V_{LC}$ is ± VH. The pulse width Tw has a waveform corresponding to the phase difference between the reference voltage $V_{REF}$ and the voltage Vpix of the pixel electrode. Thus, by varying the level of the analog voltage V1 corresponding to the data signal, the pulse width Tw of the voltage $V_{LC}$ is adjusted so as to control the effective value or average value of the voltage supplied to the liquid crystal layer 5.

When the level of the voltage V1 is varied from V1*a* to V1*b* as represented by a dashed line of FIG. 2(*a*), the timing of which the output level of the output voltage V2 of the voltage comparator 3 varies is shifted. Thus, the phase of the output voltage $V_{pix}$ of the waveform shaper 4 is also shifted. Thus, the pulse width of the voltage supplied to the liquid crystal layer 5 is varied from Tw1 to Tw2. Consequently, the effective value or average value of the voltage $V_{LC}$ supplied to the liquid crystal display 5 is controlled. In FIG. 2(*e*), a solid line represents the effective value $V_{LC}$ (1*a*) of the voltage $V_{LC}$ of the input voltage V1*a* of the voltage comparator 3. A dotted dashed line represents the effective value $V_{LC}$ (1*a*) of the voltage $V_{LC}$ of the input voltage V1*b* of the voltage comparator 3. A two-dotted dashed line represents the average value $V_{LC}$ (avr.) of the voltage $V_{LC}$ of the input voltage V1*a* of the voltage comparator 3.

Since the liquid crystal generally operates corresponding to the effective value of the voltage $V_{LC}$ , by varying the pulse width Tw of the voltage $V_{LC}$ , the effective voltage supplied to the liquid crystal layer 5 is controlled. Thus, the optical response (transmissivity of light and reflection rate) is varied and a picture is displayed. Of course, since the average value of the voltage $V_{LC}$ is also controlled, the optical response of the liquid display can be controlled corresponding to the average value of the voltage $V_{LC}$ .

In this case, as an example of the liquid crystal that composes the liquid crystal layer 5, a guest host type liquid crystal is used. A guest host type liquid crystal of which a host liquid crystal is rotated for 90 to 360°, an amorphous guest host type liquid crystal that is randomly oriented, and the like are preferably used so as to improve the reflection rate. In addition, as another example of the liquid crystal that composes the liquid crystal layer, a TN type liquid crystal may be used. Moreover, a cholesteric liquid crystal, a ferroelectric liquid crystal, an antiferroelectric liquid crystal, a polymer dispersion type liquid crystal, an OCB mode liquid crystal, and so forth may be used. In addition, the display method is not restricted. As categories of light modulating method of liquid crystal layer, a method for controlling transmission and absorption, a method for controlling transmission and scattering, or a method for controlling scattering and absorption may be used.

In the case that the liquid crystal layer 5 is composed of a ferroelectric liquid crystal, an antiferroelectric liquid crystal, or the like and that a voltage $V_{LC}$ with the profile as shown in FIG. 2(*e*) is supplied, since the optical response of the liquid crystal to the voltage supplied to the liquid crystal is high, the optical response of the liquid crystal depends on the average value $V_{LC}$ (avr) of the voltage $V_{LC}$ .

According to the liquid crystal display device of the present invention, since the number of devices that composes a pixel unit is large, the apparatus is suitable for a reflection type liquid crystal display device of which an insulation film is disposed over the devices that compose the pixel unit and pixel electrodes are formed on the insulation film. The liquid crystal display device may be applied for the transmission type liquid crystal display device. In this case, the size of pixels may become large to some extent. Anyway, by raising the integration rate of devices that compose a pixel unit, the size of pixels can be decreased. In addition, the present invention can be applied for both a monochrome liquid crystal display device and a color liquid crystal display device. Moreover, the liquid crystal layer may be a single layer or multiple layers.

In the liquid crystal display device with such a structure according to the present invention, when a still picture is displayed, after data signals for one screen are written to the storage capacitors (Cs2) 14 of all pixels, a relevant scanning line driving circuit is stopped. Thus, the relevant gate pulse (scanning signal) can be stopped. In addition, the relevant signal line driver can be stopped. Consequently, the relevant data signal can be stopped. When peripheral driving circuits such as the scanning line driver and the signal line driver are stopped, the powers of the driver circuits can be turned off. Thus, the power consumption for the AC voltage can be reduced. In addition, the power consumption for the DC voltage can be reduced. Consequently, the overall power consumption becomes zero.

In the example of the driving operation of the liquid crystal display device shown in FIG. 2, the frequencies of the reference voltage $V_{REF}$ and the voltage $V_{COM}$ of the opposite electrode that are AC voltages supplied to the liquid crystal layer 5 are as low as around 20 Hz. Thus, the power consumption of the external circuits that supply the reference voltage $V_{REF}$ and the voltage Vco of the opposite electrode are as small as ten several mW. In this case, the circuit of the pixel unit is composed of a CMOS circuit with a polycrystal Si TFT. Likewise, the DC power consumption is also small.

When the present invention is applied for a liquid crystal display device with a diagonal length of 13 inches (namely, A4 size, 1,600×1,200 pixels), the power consumption is as small as 50 mW. Whenever the voltage supplied to the liquid crystal layer 5 varies by several % due to the discharge of the storage capacitor Cs2, the same data signal should be written. However, since this interval is several seconds to several minutes, the average power consumption increases by several ten mW.

In FIG. 2(*a*), the profile of the reference voltage $V_{REF}$ is a ramp-shaped wave. Instead, as shown in FIG. 2(*f*), the profile may be a stair-step shaped wave. In this case, the number of steps of the wave may be matched with the number of levels of the gradation. Even if the input voltage V1 of the voltage comparator 3 deviates to some extent, a picture can be displayed with predetermined gradation. Thus, even if the electric characteristics of devices that compose a storage capacitor and a switching device deviate to some extent, a picture can be equally displayed. In the case of a high resolution liquid crystal display device of which the small size of pixel unit is small, since the number of levels of gradation per pixel is 16, when the profile of the reference voltage $V_{REF}$ is a stair-step shape, it is very effective.

Next, with reference to waveforms shown in FIGS. 3(*a*) to 3(*f*), a sampling operation of the voltage of a data signal will be described.

When the liquid crystal display device mainly displays still pictures (such as a document viewer), a data signal can be freely sampled. However, when a moving picture or a still picture being displayed is changed, to prevent the picture on the display from getting disordered, the sampling timings of the data signals of the pictures should be matched.

Figure 3:
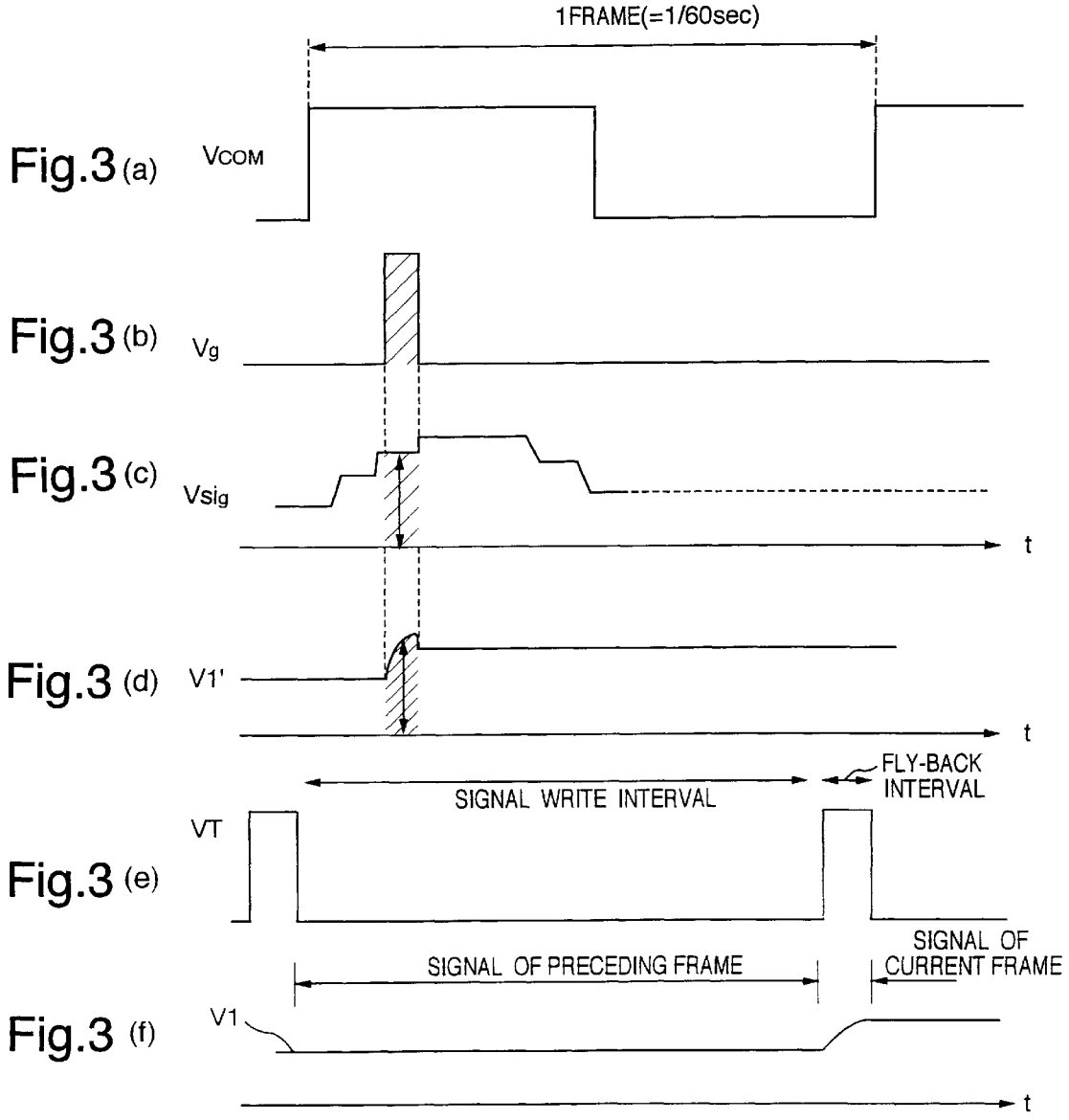
FIGS. 3(*a*) to 3(*f*) are profiles showing for explaining the driving operation of the liquid crystal display device according to the present invention.

FIGS. 3(*a*) to 3(*f*) are graphs for explaining the driving operation of the liquid crystal display device according to the present invention in that case that the sampling timings are matched.

FIG. 3(*a*) shows a profile of the voltage $V_{COM}$ supplied to the opposite electrode 7. The profile of the voltage $V_{COM}$ is equivalent to the profile of the output voltage of the voltage comparator 3 to which the voltage V1 and the reference voltage $V_{REF}$ are supplied.

FIG. 3(*b*) shows a profile of a scanning signal supplied to the gate line (Gn) 9.

FIG. 3(*c*) shows a profile of a data signal supplied to the signal line (Sm) 8.

FIG. 3(*d*) shows a profile of the voltage V1' stored in the storage capacitor $C_{s1}$2.

FIG. 3(*e*) shows a profile of a scanning signal supplied to the timing line 13.

FIG. 3(*f*) shows a profile of the voltage V1' stored in the storage capacitor $C_{s2}$14.

Considering a pixel at line n and column m, when the level of the voltage of the scanning signal supplied to the scanning line 9 becomes high, the transistor 1 is turned on (assuming that the transistor 1 is of n-ch type). When the transistor 1 is turned on, the voltage Vsig of the data signal supplied to the signal line 8 is sampled. The voltage Vsig of the data signal is stored in the storage capacitor (Cs1) 2 as the voltage V1' through the source and drain of the transistor 1.

Since the conventional TV signal is basically used for a CRT, there is a fly-back interval. In the case of another signal source, the display rewrite interval (signal rewrite interval) is slightly shorter than one frame interval. Thus, a remaining time region is obtained. In the time region, when the signal level of the voltage VT becomes high, the transistor 12 is turned on. Thus, the voltage V1' stored in the storage capacitor (Csl) 2 can be moved to the storage capacitor (Cs2) that stores the input voltage V1 of the voltage comparator 3 at the same timing in one frame. Thus, regardless of the position of a pixel in the display screen, since a proper analog signal corresponding to the data signal is supplied to the voltage comparator 3 for each frame. Consequently, even if a moving picture is displayed, the picture on the display can be prevented from becoming disordered. Thus, the picture with a high quality can be displayed. In addition, since the stored electric charge is divided, the voltage V1 becomes smaller than the voltage V1'. However, considering the decrease of the voltage, the data signal Vsig is supplied.

In the structure of the pixel of the liquid crystal display device according to the present invention shown in FIG. 1, the waveform shaper 4 has a set terminal and a reset terminal. One of the set terminal and the reset terminal of the waveform shaper 4 is connected in common with each pixel. In the example shown in FIG. 1, the set terminal of a pixel at line n and column m is connected to the storage capacitor line 11. The reset terminal of a pixel at line (n+1) and column n is connected to the storage capacitor line 11.

The reset terminal and the reset terminal of the waveform shaper 4 for each pixel can be freely connected to the storage capacitor line 11. The polarity of the voltage supplied to the liquid crystal layer 5 in the case that the set terminal is connected to the storage capacitor line 11 is different from that in the case that the reset terminal is connected to the storage capacitor line 11. When the same terminals of the waveform shapers 4 are connected to the storage capacitor lines 11, the balance of the polarities on the entire display screen is lost. Thus, the picture on the display may flicker.

When connections of the set terminals and reset terminals of the waveform shapers 4 are changed for each adjacent pixel or every several pixels, since the polarities of the entire display can be balanced, a picture on the display can be suppressed from flickering. When the opposite electrode 7 is composed of a transparent conductive film such as ITO (Indium Tin Oxide), crosstalk can be prevented without need to decrease the resistance of the transparent conductive film.

Thus, when the set terminals and the reset terminals are connected to the storage capacitor lines 11 in such a manner that the polarities of the entire display are balanced, a picture can be displayed almost free of flickering and crosstalk.

In addition, the profile of the reference voltage $V_{REF}$ supplied to the reference voltage line 10 can be alternately varied between line (n) and line (n+1). For example, a ramp wave of which the voltage gradually increases is supplied to the reference voltage line 10 at line n. A ramp wave of which the voltage gradually decreases is supplied to the reference voltage line 10 at line (n+1).

When the liquid crystal display device is initially operated, the voltage applied to the storage capacitor line 11 is set to high level. Thereafter, the voltage is set to low level. Thus, the phase of the voltage V1 of each pixel against the reference voltage $V_{REF}$ can be determined.

FIG. 4 is a circuit diagram showing the structure of the voltage comparator 3. FIGS. 5(*a*), 5(*b*), and 5(*c*) are circuit diagrams showing the structure of the waveform shaper. FIG. 5(*a*) is a circuit diagram showing the structure of a logic circuit of the waveform shaping circuit. FIG. 5(*b*) is a circuit diagram showing an NAND circuit that is a structural element of the logic circuit shown in FIG. 5(*a*). FIG. 5(*c*) is a circuit diagram showing an inverting circuit that is a structural element of the logic circuit shown in FIG. 5(*a*). In the liquid crystal display device shown in FIG. 1, these logic gate circuits are TFT CMOS circuits of which polycrystal Si is used for a channel. The present invention is not limited to such a structure. In other words, the logic gate circuits may be composed of only n-channel transistors. The thin film transistors may be amorphous silicon TFTs or TFTs that are composed of a compound semiconductor such as CdSe.

The method for generating the AC voltage corresponding to the data signal is not limited to the method for supplying two AC voltages with a phase difference to the two electrodes oppositely disposed with the liquid crystal layer. Instead, with a three-value comparator, an AC voltage can be generated. In the three-value comparator, the levels of two AC voltages is compared. If the difference of the levels is almost zero, a reference voltage (for example, a ground voltage) is output. If one of the two levels is positive, a predetermined positive voltage (for example, $+V_0$) is output. If one of the two levels is negative, a predetermined negative voltage ($-V_0$) is output. By supplying the output voltage of the three-value comparator to one electrode (for example, a pixel electrode) and a constant voltage to the other electrode (for example, an opposite electrode), an AC voltage corresponding to the data signal can be supplied to the liquid crystal layer.

Figure 1B:
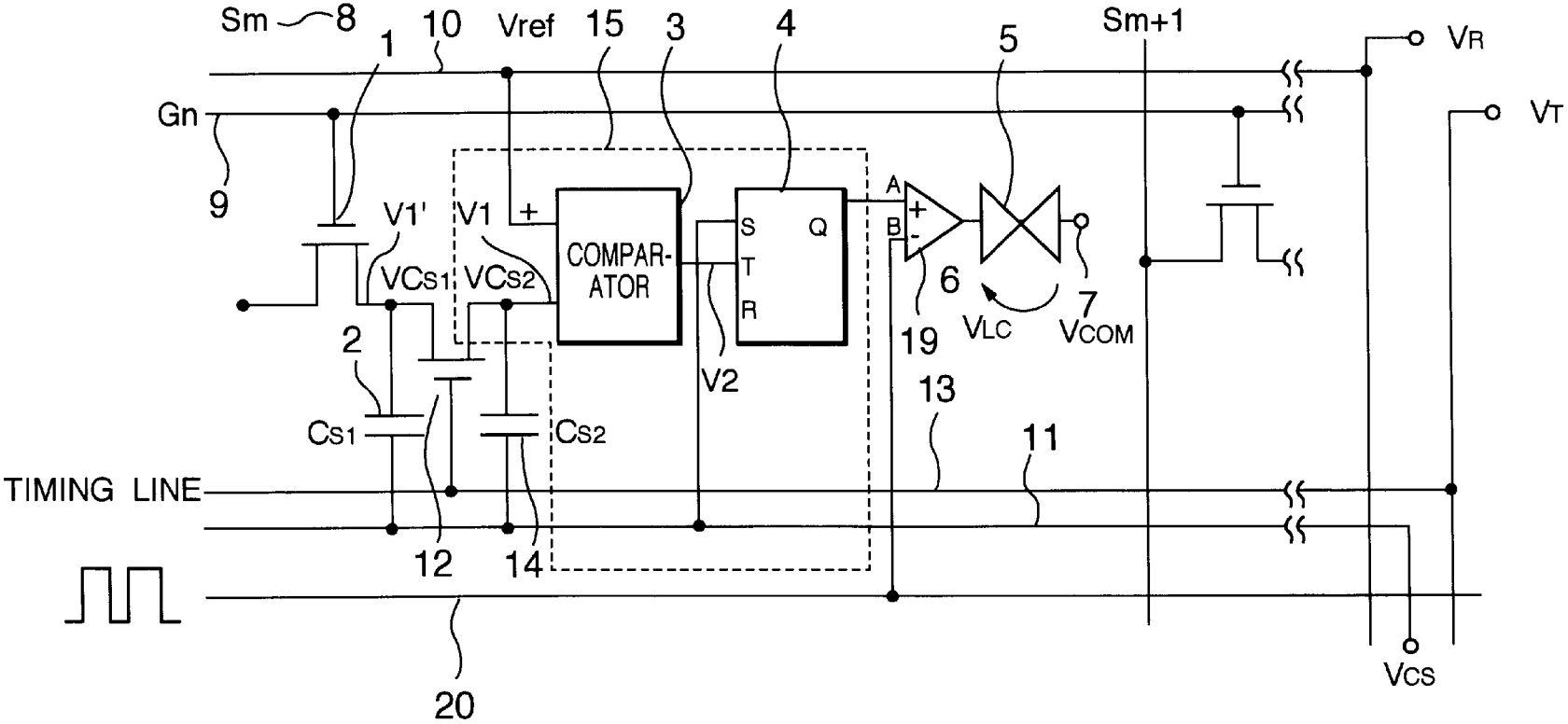
FIG. 1B is an equivalent circuit diagram showing another structure of a pixel of a liquid crystal display device according to the present invention.

As an example of such a structure shown in FIG. 1B, the three-value comparator 19 can be disposed between the waveform shaper 4 and the pixel electrode 6. At this point, a line 20 for supplying a predetermined AC voltage (with a profile as shown in FIG. 2(*d*)) is disposed on the array substrate side.

Figure 1C:
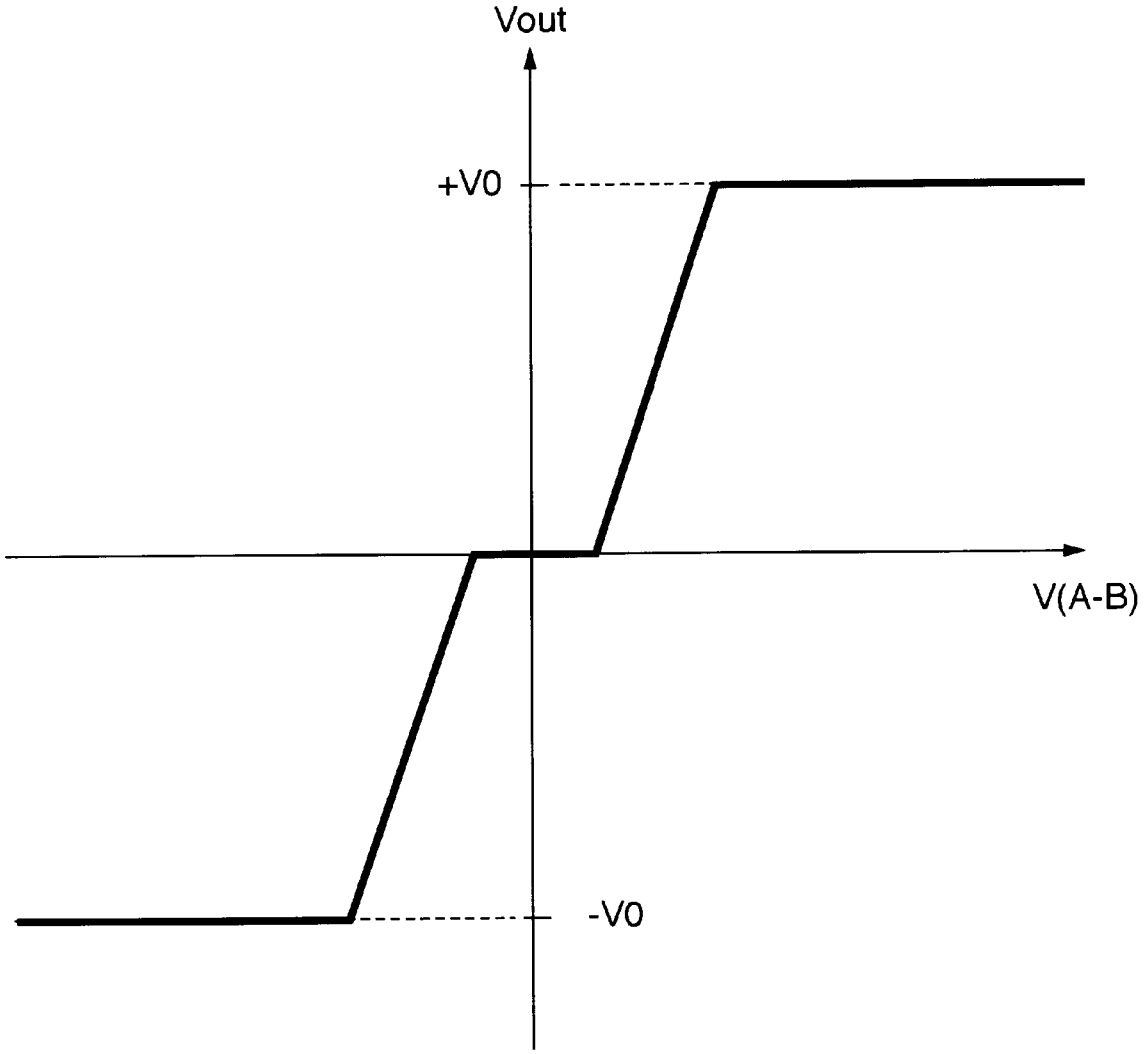
FIG. 1C is a graph showing a characteristics of the three-value comparator 19 shown, as a relationship between voltages ($V_A$–$V_B$) and the output voltage $V_{OUT}$ of the three-value comparator 19.

The characteristics of the three-value comparator 19 shown in FIG. 1C, as a relationship between voltages ($V_A$–$V_B$) and the output voltage $V_{OUT}$ of the three-value comparator 19. One input voltage of the three-value comparator 19 is an AC voltage ($V_A$) that is received from the waveform shaper 4. The other input voltage to the three-value comparator 19 is an AC voltage ($V_B$) as shown profile (d) in FIG. 2. The three-value comparator 19 compares the polarities of the two input voltages. If the difference between the two input voltages ($V_A$–$V_B$) is almost zero, a reference voltage $V_{REF}$ (ground voltage) is output to the pixel electrode 6. If the difference between the two input voltages ($V_A$–$V_B$) is positive, a constant positive voltage $+V_0$ is output to the pixel electrode 6. If the difference between the two input voltages ($V_A$–$V_B$) is negative, a constant negative voltage $-V_O$ is output to the pixel electrode 6.

With such a structure, an AC voltage corresponding to the data signal is generated in the pixel and supplied to the liquid crystal layer 5. In this case, since the opposite voltage is held at a predetermined voltage, it is not necessary to supply an AC voltage. In addition, with an integrating circuit disposed downstream of the three-value comparator, the output voltage waveform of the three-value comparator can be smoothed and supplied to the pixel electrode.

(Second Embodiment)

Figure 6:
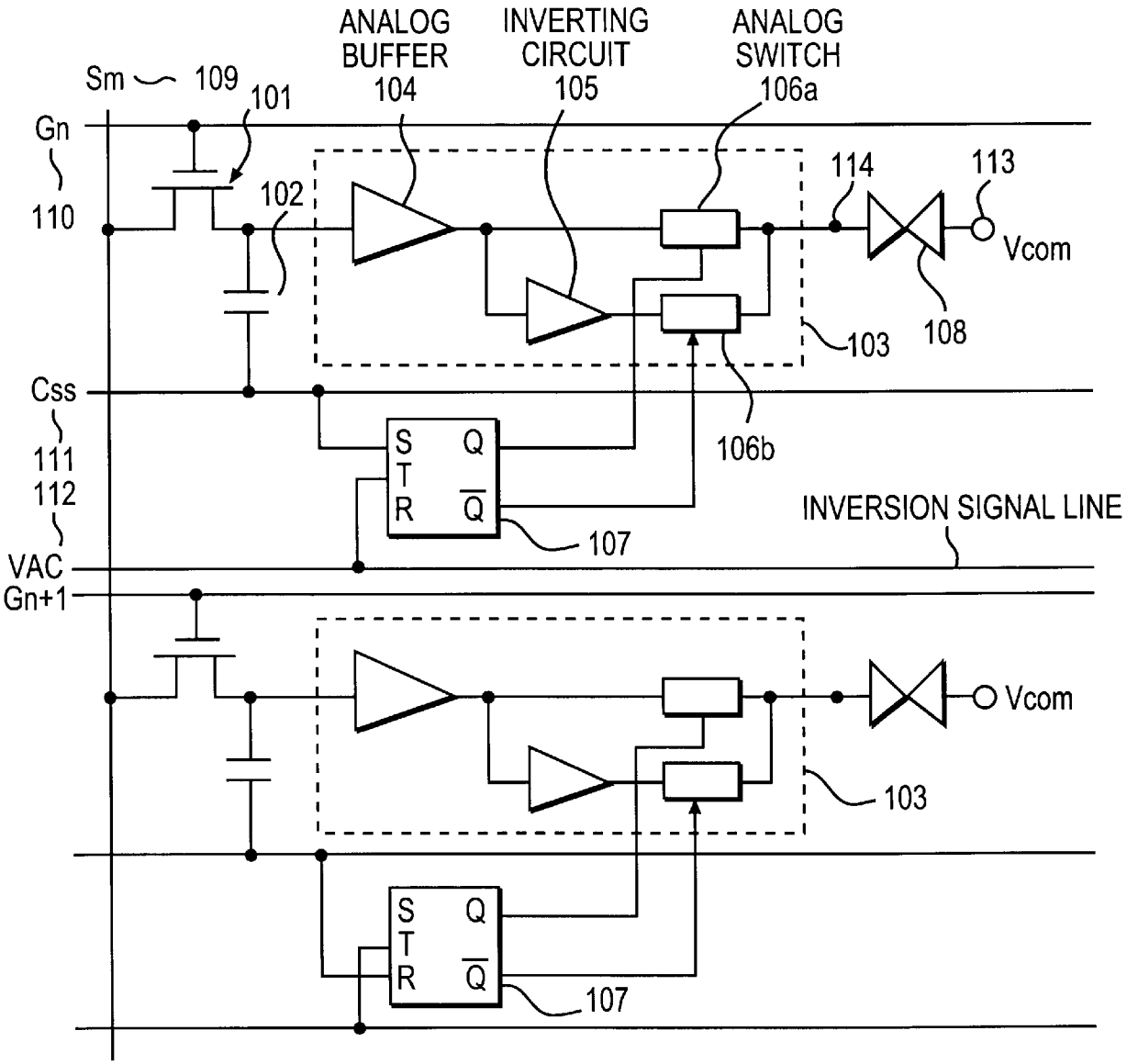
FIG. 6 is a circuit diagram showing the structure of a pixel of a liquid crystal display device according to a second embodiment of the present invention.

FIG. 6 is an equivalent circuit diagram showing the structure of a pixel of a liquid crystal display device according to a second embodiment of the present invention.

A pixel unit of the liquid crystal display device comprises a transistor 101, a storage condenser 102, and an inverting circuit 103. The transistor 101 samples a data signal. The storage capacitor 102 stores the data signal sampled by the transistor 101. The inverting circuit 103 inverts the polarity of the data signal and supplies the inversion data signal to a pixel electrode 114. A liquid crystal layer 108 is disposed between the pixel electrode 114 and an opposite electrode 113.

When the thin film transistor 101 is turned on with a scanning signal Vg supplied to a scanning line 110, a data signal Vsig supplied to a signal line 109 is sampled and stored in the storage capacitor 102. The voltage stored in the storage capacitor 102 is denoted by V1.

The inverting circuit 103 comprises an analog buffer 104, a polarity inverter 105, and analog switches 106*a* and 106*b*. The voltage V1 stored in the storage capacitor 102 is supplied to the analog buffer 104. The analog buffer 104 outputs a voltage V2 corresponding to the voltage V1. The polarity inverter 105 inverts the polarity of the output voltage V2 of the analog buffer 104. The output voltage V2 of the analog buffer 104 or an output voltage −V2 of the polarity inverter 105 are selected by the analog switches 106*a* and 106*b* and the selected voltage is supplied to the pixel electrode 114. In other words, pulses (an AC voltage) corresponding to the data signal whose polarity is inverted by the analog switches 106*a* and 106*b* are generated and supplied to the pixel electrode 114. Thus, in the liquid crystal display device according to the present invention shown in FIG. 6, an AC voltage is generated with an analog signal stored in the pixel unit.

As a necessary condition, the input voltage V1 of the analog buffer 104 just accords with the output voltage V2 thereof. For example, the input voltage V1 may be 5 V, whereas the output voltage V2 may be 5 V. Alternatively, the input voltage V1 may be 1 V, whereas the output voltage V2 may be 1 V. The analog buffer 104 prevents the voltage V2 from fluctuating when the analog switches 106*a* and 106*b* are operated.

In addition, the polarity inverter 105 which outputs −ΔV corresponding to an input +ΔV can be employed in the invention. For example, it is not needed to output −5V when +5V is input. In these case, $V_{COM}$ should not be kept 0V so as to compensate the center value of the output levels of the polarity inverter 105.

The analog switches 106*a* and 106*b* are switched corresponding to the inversion signal Vac supplied to the inversion signal line 112. In this case, a flip-flop 107 controls the switching timings of the analog switches 106*a* and 106*b*. The period of the AC signal supplied to the pixel electrode 114 is twice the period of the inversion signal Vac. When the frequency of Vac is 120 Hz, an AC voltage with a frequency of 60 Hz is supplied.

As with the first embodiment, in the liquid crystal display device shown in FIG. 6, with the set signal and the reset signal that represent the polarities of the flip-flop, the polarity of the voltage for each pixel can be controlled. In the example shown in FIG. 6, with respect to the pixel at line n and column m, the set terminal is connected to the storage capacitor line 11. With respect to the pixel at line (n+1) and column m, the reset terminal is connected to the storage capacitor line 11. Thus, when the set terminal and the reset terminal connected to the storage capacitor line 11 are varied for each pixel in such a manner that the polarities of the entire display screen can be balanced, a picture with a good quality free from flickering and crosstalk can be obtained. In this embodiment, the set signal and the reset signal are supplied from the auxiliary capacitor line 111. However, the set signal and the reset signal can be supplied with another supply line.

In the liquid crystal display device shown in FIG. 6, since each pixel generates an AC voltage, the structure of the transistor 12 shown in FIG. 1A for supplying data signals to the entire display is not required. Since the voltage supplied to the opposite electrode 113 is constant, it is not necessary to supply an AC voltage. Thus, the power consumption of the liquid crystal display device can be reduced.

(Third Embodiment)

Figure 7:
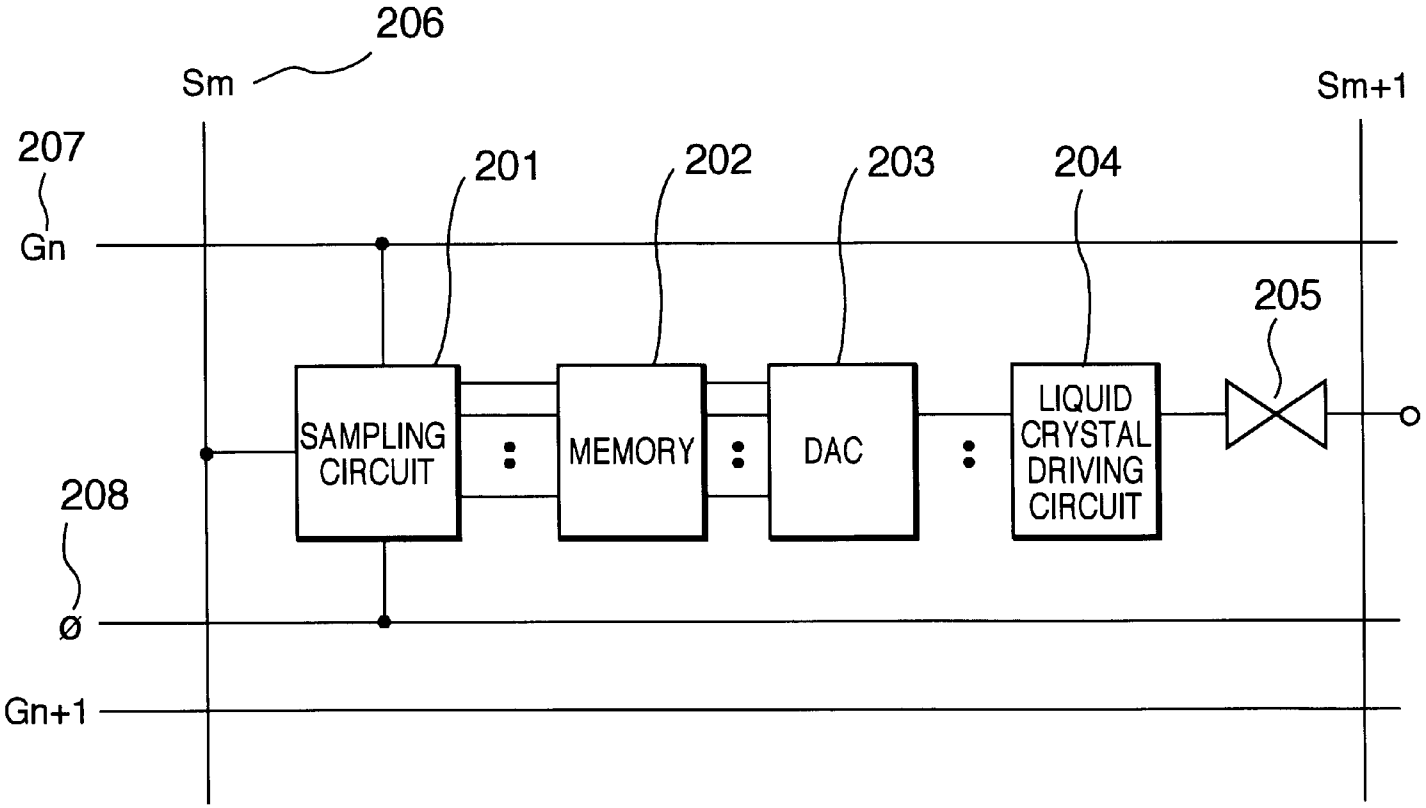
FIG. 7 is a circuit diagram showing the structure of a pixel of a liquid crystal display device according to a third embodiment of the present invention.

FIG. 7 is a block diagram showing the structure of a pixel of a liquid crystal display device according to a third embodiment of the present invention.

In the liquid crystal display device, a digital data signal corresponding to gradation of a pixel is supplied to a signal line 206. A sampling circuit 201 samples the digital data signal. Reference numeral 207 is a gate line. The sampled data signal is stored in a memory 202. The memory 202 has a digital memory that stores digital data. The number of signal lines 206 may correspond to the number of bits of the data signal. In this example, the data signal is supplied on time division basis. Data of each bit is sampled corresponding to a clock signal supplied to a clock signal line 208. It should be noted that the data signal may be supplied corresponding to another method.

In the liquid crystal display device shown in FIG. 7, as a basic feature, the memory 202 stores digital data. It should be noted that after an analog data signal is supplied to the signal line, the analog signal is converted into digital data by an analog-digital converter(ADC) and then stored to the memory 202.

An output signal of the memory 202 is converted into an analog signal by a digital-analog converter (DAC) 203. The resultant analog signal is supplied to a liquid crystal layer 205 through a liquid crystal driving circuit 204. Examples of the liquid crystal driving circuit 204 are the driving circuit 15 shown in FIG. 1A and the driving circuit 103 shown in FIG. 6.

In the liquid crystal display device shown in FIG. 7, since the memory stores digital data, the data signal can be stored without fluctuation of characteristics of the sampling circuit and the memory circuit. Thus, the picture quality can be improved. In addition, since the memory 202 is composed of a thin film transistor, the number of devices disposed on the liquid crystal display device can be reduced. Moreover, the refresh operation can be almost omitted. Thus, even if the power of the liquid crystal display device is turned off, when it is turned on, the preceding picture can be displayed. Consequently, an external video memory can be omitted. As a result, the cost of the liquid crystal display device can be reduced. In addition, the power consumption can be further reduced.

(Fourth Embodiment)

Figure 8:
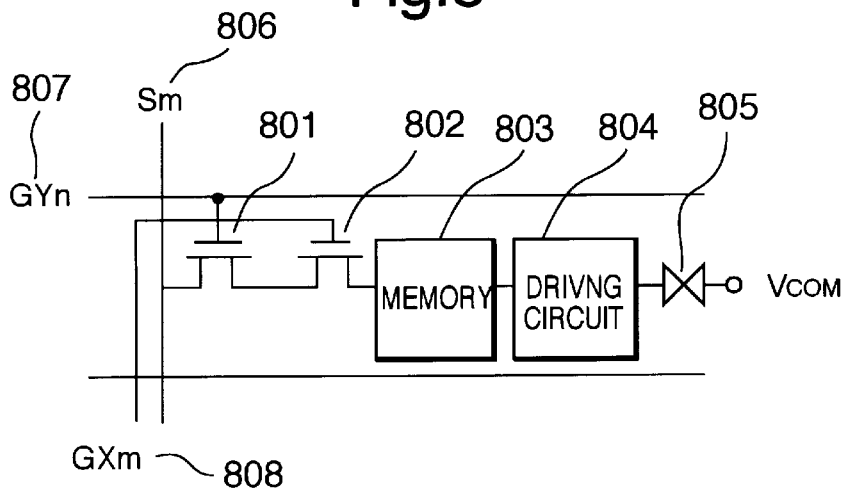
FIG. 8 is a circuit diagram showing the structure of a pixel of a liquid crystal display device according to a fourth embodiment of the present invention.

FIG. 8 is a circuit diagram showing the structure of a liquid crystal display device according to a fourth embodiment of the present invention.

In the structure of a pixel shown in FIG. 8, when both transistors 801 and 802 are turned on at the same time, a data signal supplied to a signal line 806 can be sampled to a pixel. Thus, a data signal can be written to any pixel of the display screen.

The transistor 801 is turned on and off with a signal supplied to a Y gate line 807. The transistor 802 is turned on and off with a signal supplied to an X gate line 808. A memory circuit 803 and a liquid crystal driving circuit 804 are disposed downstream of the transistors 801 and 802. A voltage is supplied to a liquid crystal layer 805.

Since a data signal can be written to any pixel of the display, only the data signal for a pixel that changes is rewritten. Thus, the intensity of data signal can be reduced and thereby the power consumption can be reduced.

In addition, when a still picture has a window for displaying a moving picture, a data signal can be written to the window for the moving picture at high speed.

In the example shown in FIG. 8, the sampling means for writing a data signal to any pixel of the display is composed of two transistors. However, the sampling means may be structured in another method. For example, the sampling means may be structured in such a manner that when the voltage of a non-linear device exceeds a predetermined voltage, the device is turned on and thereby a data signal is selected.

(Fifth Embodiment)

Figure 9:
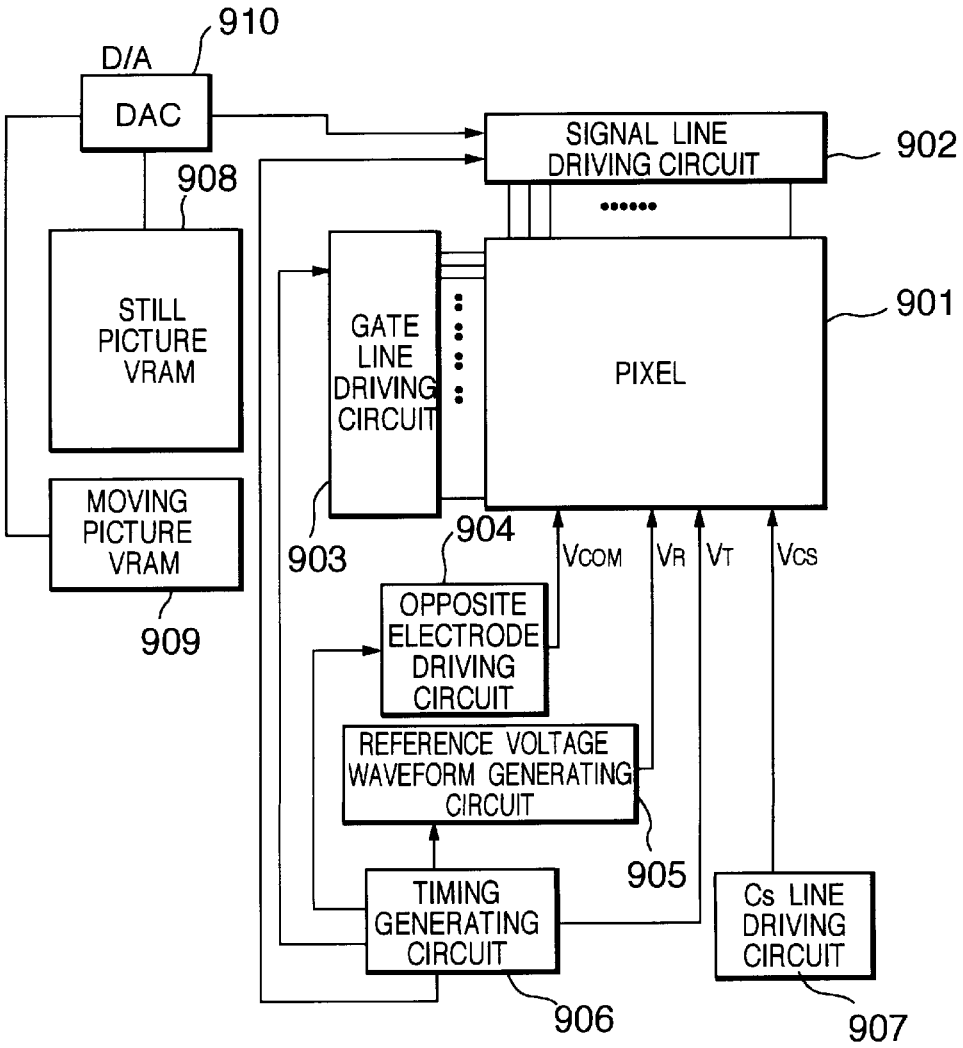
FIG. 9 is a block diagram showing the structure of a liquid crystal display device corresponding to a fifth embodiment of the present invention.
Figure 10:
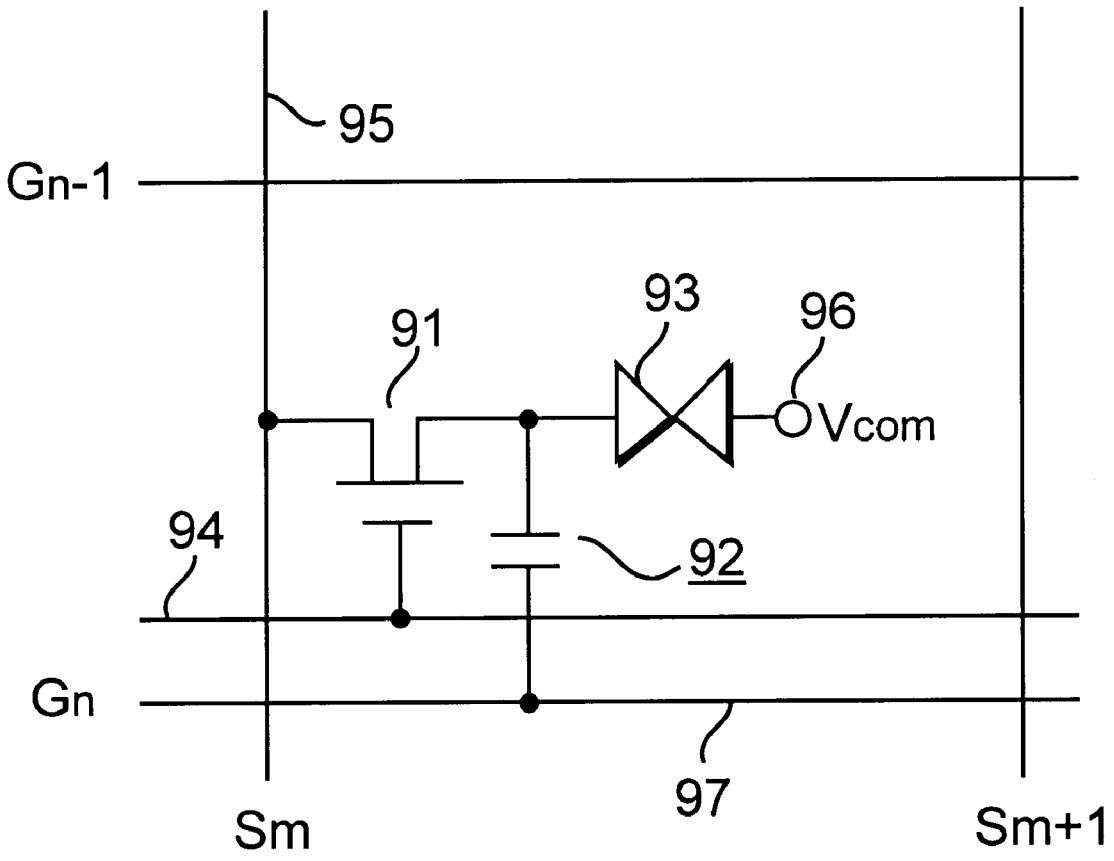
Fig. 10 PRIOR ART
FIG. 10 is a schematic diagram showing the structure of a pixel of a conventional liquid crystal display device.

FIG. 9 is a system block diagram showing a liquid crystal display device according to a fifth embodiment of the present invention.

The liquid crystal display device shown in FIG. 9 is a modification of the fourth embodiment of the present invention.

As shown in FIG. 9, each pixel of the liquid crystal display device 901 with the structure shown in FIG. 1A is connected to a signal line driving circuit 902, a gate line driving circuit 903, an opposite electrode driving circuit 904, a reference voltage waveform generating circuit 905, a timing generating circuit 906, and a CS line driving circuit 907. A data signal received from a still picture VRAM 908 and a moving picture VRAM 909 is supplied to a signal line driving circuit 902 through a D/A converting circuit 910. The timing generating circuit 906 supplies a predetermined timing signal to the scanning line driving circuit 903, a signal line driving circuit 902, each pixel (that composes the display screen 901), the opposite electrode driving circuit 904, and the reference voltage waveform generating circuit 905. Thus, the liquid crystal display device is driven.

In the example of the liquid crystal display device shown in FIG. 9, the moving picture VRAM 909 supplies a data signal for a moving picture. Thus, the signal supplied from the still picture RAM 908 can be stopped. Consequently, the power consumption can be reduced. One VRAM may be used for a moving picture and a still picture. A data signal of a moving picture may be stored in part of the VRAM. In this case, likewise, the power consumption can be reduced.

Modifications of circuit structure and display method of the embodiment shown in FIG. 1A can be applied for the above-described embodiments.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

As described above, according to the liquid crystal display device of the present invention, the power consumption can be reduced. Thus, when portable electronic units such as portable information terminals are operated with batteries, the operation time thereof can be prolonged. In addition to the memory characteristic for storing data signals, pixels can display gradation. Thus, the amount of information of a picture to be displayed can be increased. Moreover, the display quality can be improved.

(Sixth Embodiment)

Next, a method for generating an AC voltage corresponding to a display signal in a pixel will be described.

As another method for generating an AC signal corresponding to a sampled display signal, a resistance component connected to a liquid crystal layer may be varied corresponding to a display signal. When the resistance component is varied, the time constant of the AC voltage corresponding to the display signal applied to the liquid crystal layer can be controlled.

Figure 11A:
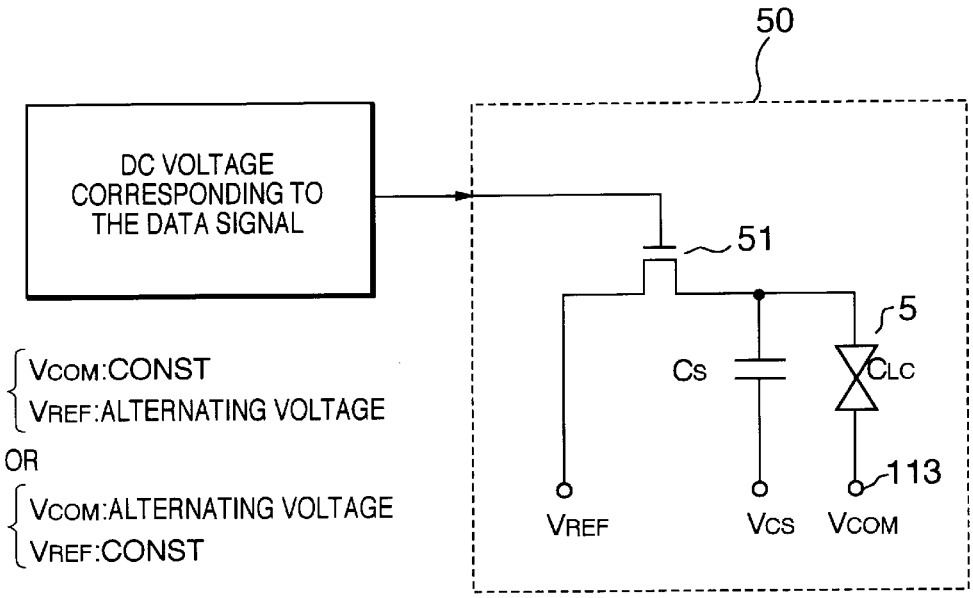
FIG. 11A, FIG. 11B, FIG. 11C, FIG. 11D, FIG. 11E, and FIG. 11F are equivalent circuit diagrams showing the structure of a pixel having a capability of generating a AC voltage corresponding to the sampled data signal according to the present invention.

FIG. 11A is a schematic diagram showing an example of the structure of such a circuit 50.

An analog DC voltage corresponding to a display signal that is output from the above-described memory means and analog buffer is supplied to the gate of a transistor 51. The source and drain of the transistor 51 are disposed between a line for supplying a reference voltage $V_{REF}$ and a pixel electrode. When a resistance $R_{TR}$ of the transistor 51 is sufficiently small, the time constant $\tau$ is nearly expressed by:

$$\tau=(C_s+C_{LC})\times R_{TR}$$

Thus, when $R_{TR}$ is varied, the time constant $\tau$ can be controlled. Consequently, the reference voltage $V_{REF}$ is modulated with the resistance $R_{TR}$ of the transistor 51 and supplied to the liquid crystal layer 5.

Figure 11B:
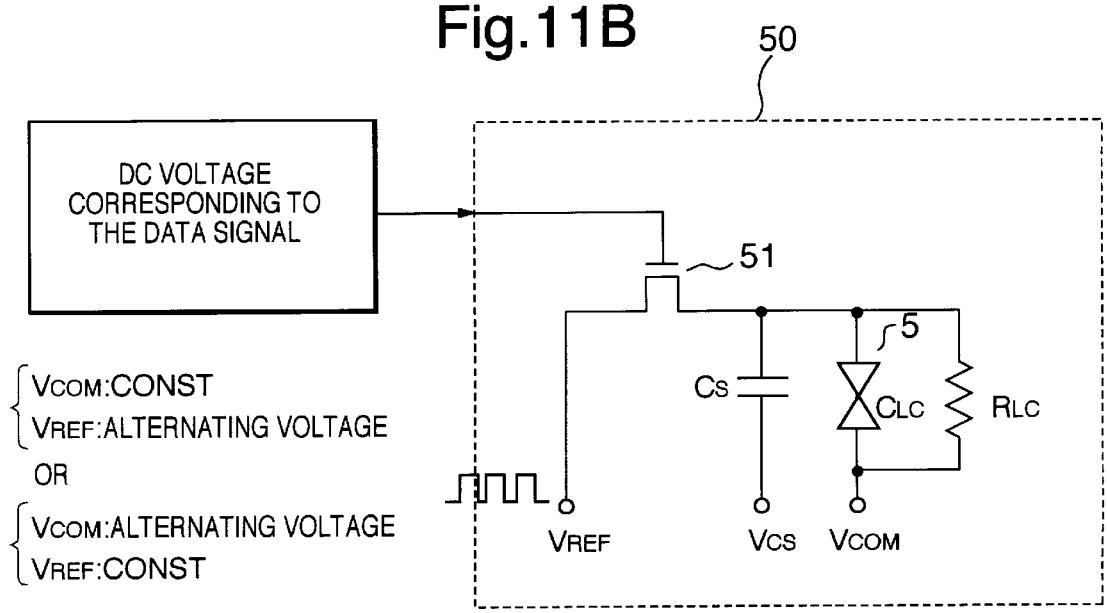

Although the liquid crystal layer is composed of a high resistance material, strictly speaking, it has an internal resistance $R_{LC}$. Thus, as shown in FIG. 11B, $V_{REF}$ is divided with the resistance $R_{TR}$ of the transistor 51 and the resistance $R_{LC}$ of the liquid crystal layer 5. To easily control the time constant, the resistance $R_{LC}$ is decreased. In this case, an conductive material or the like can be contained as an additive in the liquid crystal material that composes the liquid crystal layer 5. However, the conductive material should be added in such a manner that it does not adversely affect the picture display quality. Alternatively, a resistor may be disposed in parallel with the auxiliary capacitance $C_S$ and the capacitance $C_{LC}$ of the liquid crystal layer 5.

Figure 11C:
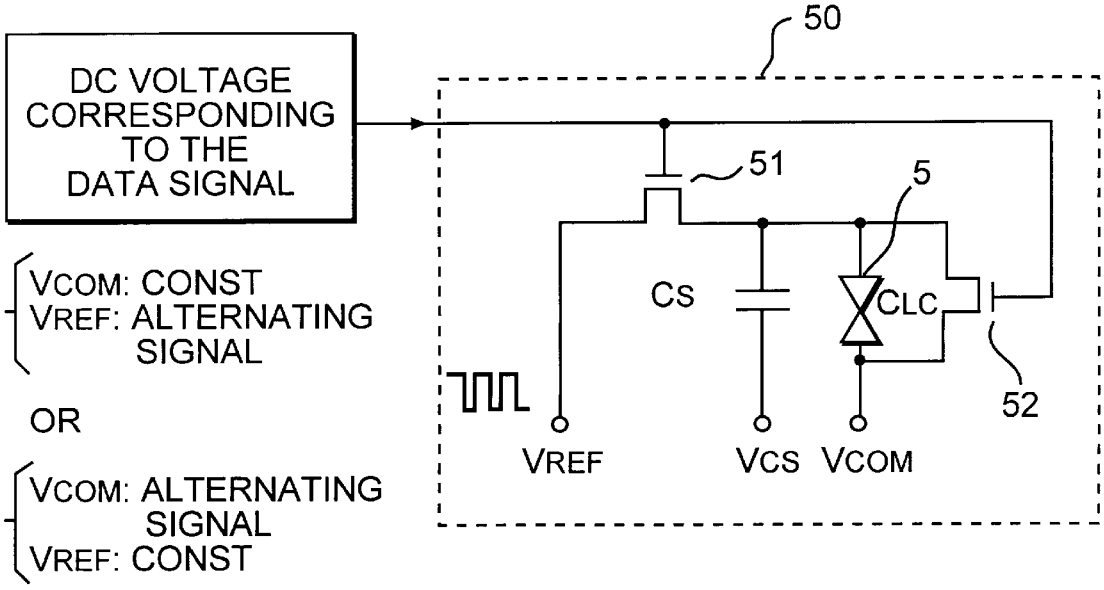

In addition, as shown in FIG. 11C, a voltage dividing resistor equivalent to the resistance $R_{LC}$ may be composed of a transistor 52. The resistance of the transistor 52 is denoted by $R_{TRX}$.

Figure 11D:
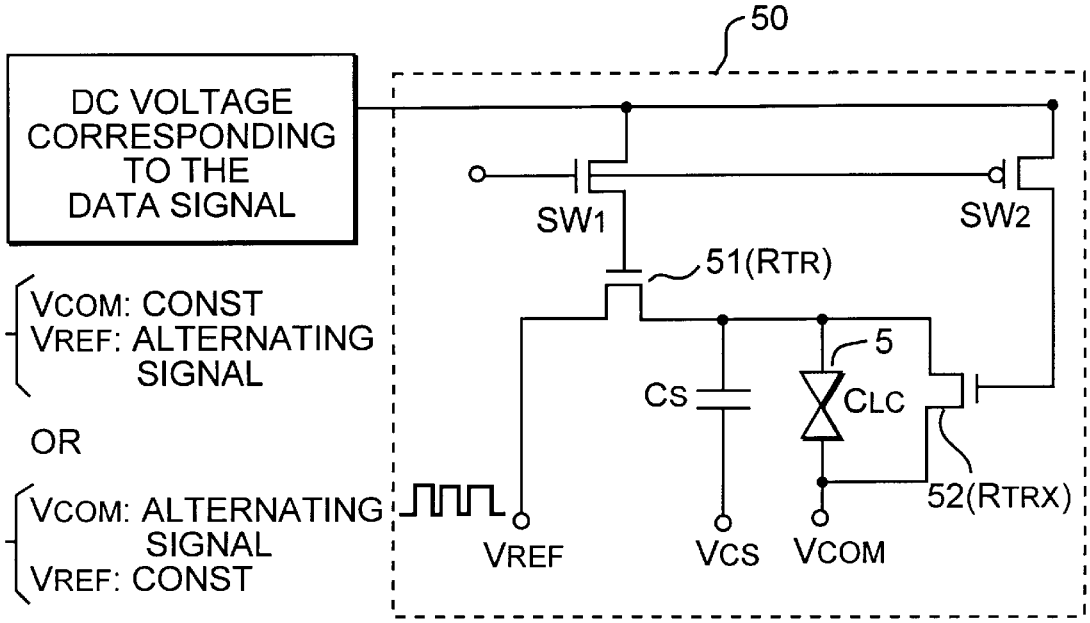

As another alternative method shown in FIG. 11D, switching devices SW1 and SW2 that control a time period for which an AC voltage is supplied to the liquid crystal layer may be disposed. The resistance $R_{TRX}$ may be accomplished with an off-resistance of a diode that has a high threshold value Vth.

The switching devices SW1 and SW2 may be used so as to synchronize a drive timing of the liquid crystal layer with the reference voltage $V_{REF}$. In this case, even if the frequency of the AC voltage supplied as the reference voltage $V_{REF}$ does not accord with the drive timing of the liquid crystal layer, when the frequency synchronizes with the timing of data transmission, by turning off the switching devices SW1 and SW2 at a proper timing of the AC signal, the AC signal can be input. Thus, it is not necessary to synchronize the signal period of the reference voltage $V_{REF}$ with the timing of the display signal that is input to the memory means and the analog buffer.

When the switching devices SW1 and SW2 are turned on, as a necessary condition, an analog buffer outputs a DC voltage corresponding to the display signal. Thus, when the analog buffer and the transistor 51 are separated with the switching devices SW1 and SW2, the power consumption of the analog buffer can be reduced.

In the structures shown in FIGS. 11A, 11B, 11C, and 11D, with an AC signal as $V_{REF}$, $V_{COM}$ may be a constant voltage. In contrast, with a constant voltage of $V_{REF}$, an AC signal may be supplied as $V_{COM}$.

The structure of which the drive voltage is divided with a resistor connected to the liquid crystal layer is particularly effective for an in-plane mode liquid crystal display apparatus of which two electrodes for driving the liquid crystal layer is formed on nearly the same plane and the liquid crystal layer is driven in horizontal electric field mode.

In the structure of the circuit 50 shown in FIGS. 11B and 11C, the AC voltage supplied to the liquid crystal layer is modulated with voltages divided by resistors. In this case, it is considered that due to for example the fabrication process of the liquid crystal display apparatus, the distribution of the voltage dividing resistors may deviate. However, in the structure of the circuit 50 shown in FIGS. 11C and 11D, a transistor 51 ($R_{TR}$) and a transistor 52 ($R_{TRX}$) that compose the voltage dividing circuit are often fabricated in the same process. Thus, it is considered that the equality of characteristics of the voltage dividing circuit is high.

Figure 11E:
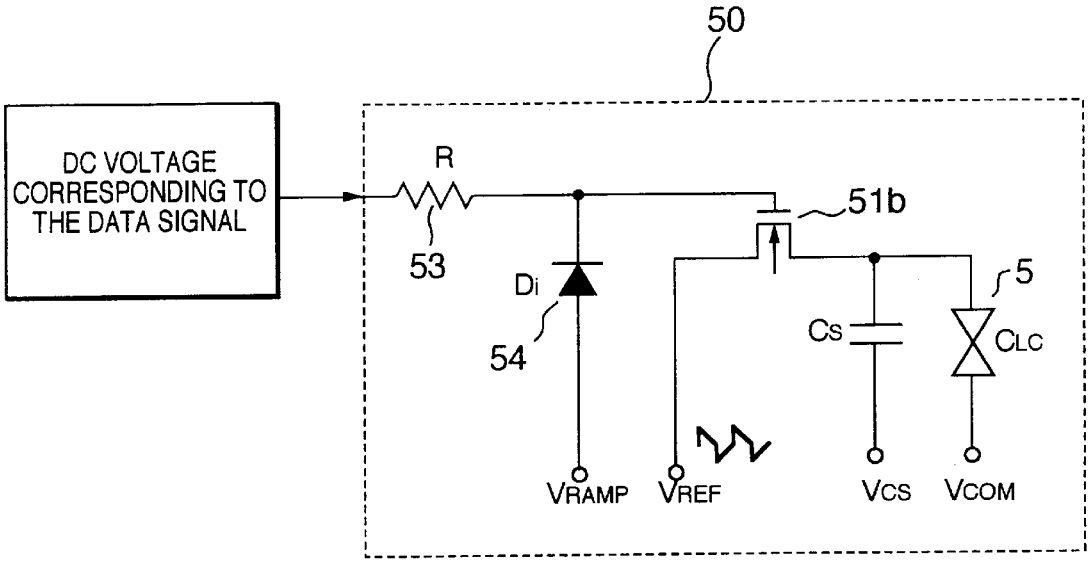

FIG. 11E is a schematic diagram showing another example of the circuit 50 that generates an AC signal corresponding to a display signal in a pixel.

Figure 12A:
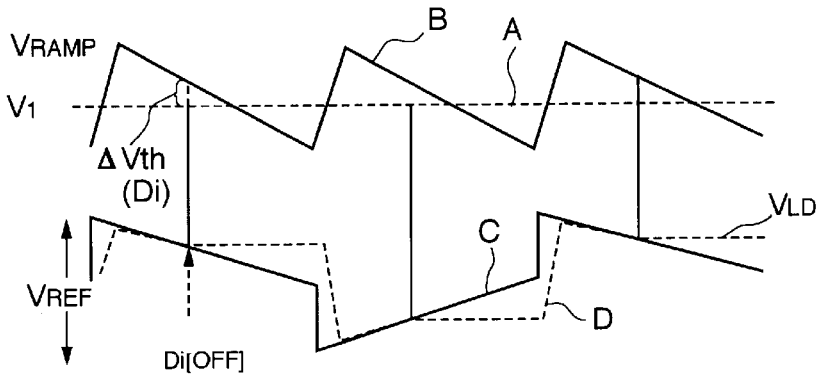
FIG. 12A, FIG. 12B and FIG. 12C showing profile of applied signals for explaining a driving operation of the pixel of the liquid crystal display device according to the present invention shown in FIG. 11E.
Figure 12B:
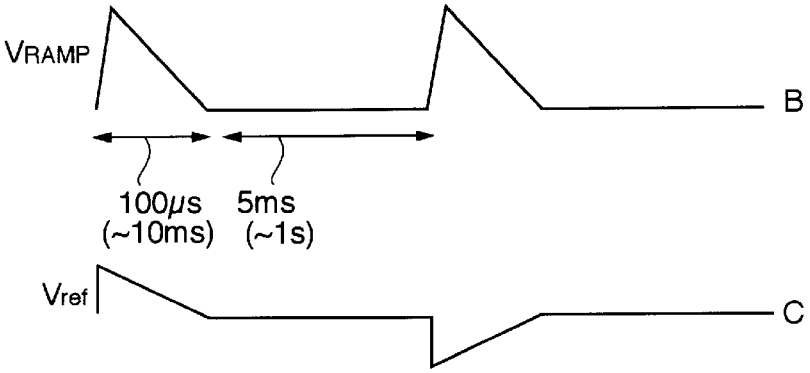
Figure 12C:
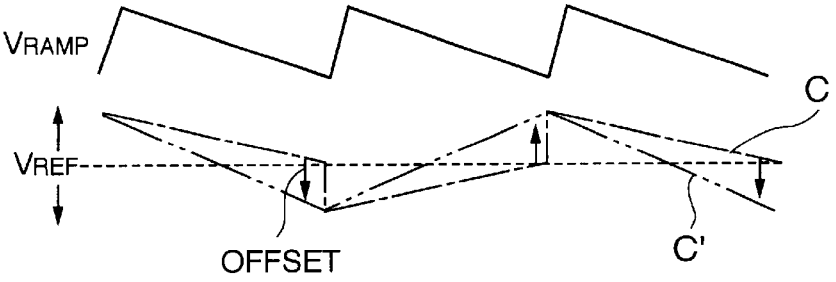

In the example shown in FIG. 11E, a DC voltage V1 corresponding to a display signal is supplied to the gate of a transistor 51*b* through a resistor 53. In addition, a ramp wave $V_{RAMP}$ compared with V1 is supplied through a diode 54. In other words, the circuit shown in FIG. 11E is equivalent to a sample and hold circuit that generates an AC signal with a ramp wave $V_{RAMP}$ that periodically varies in synchronization with $V_{REF}$. FIGS. 12A, 12B, and 12C are schematic diagrams for explaining the operation of the circuit shown in FIG. 11E. FIGS. 12A, 12B, and 12C show profiles of individual signals of the circuit shown in FIG. 11E.

The profiles of waveforms shown in FIG. 12A are:

profile A: DC voltage V1 corresponding to the display signal profile B: Ramp voltage $V_{RAMP}$ in synchronization with $V_{REF}$ profile C: Reference voltage $V_{REF}$ that is an AC voltage profile D: AC voltage $V_{LC}$ with an effective voltage or an average voltage corresponding to the display signal Assume that the diode 54 is turned on (in low resistance state), that an on-level bias voltage is supplied to the gate of the transistor 51*b*, and that the threshold voltage of the diode is denoted by Vth (Di).

When the voltage $V_{RAMP}$ of the ramp wave is smaller than the sum of the analog voltage V1 corresponding to the display signal and the threshold voltage Vth of the diode 54, the diode 54 is turned off. At this point, the bias voltage supplied to the transistor 51*b* becomes the off level. Thus, the on/off timing of the transistor 51*b* is controlled with the analog voltage V1 corresponding to the display signal.

When the transistor 51*b* is turned off, the reference voltage $V_{REF}$ in synchronization with $V_{RAMP}$ supplied to the liquid crystal layer 5 is stopped. Thus, when the timing of which the transistor 51*b* is turned off is controlled, the level of the voltage supplied to the liquid crystal layer can be controlled. As shown with the profile (c) of FIG. 12A, when the waveform of $V_{REF}$ is symmetrical with respect to 0 V, an AC voltage corresponding to the display signal is supplied to the liquid crystal 5. When the voltage of the opposite electrode is constant, the profile (D) of $V_{LC}$ shown in FIG. 12A is supplied to the liquid crystal layer 5. However, the voltage of the opposite electrode can be varied. In the case that the voltage of the opposite electrode is varied as with $V_{REF}$, when the level of V1 is the lowest level of $V_{RAMP}$, the profile (D) shown in FIG. 12A becomes the same as the profile (C). Thus, when the profile of the opposite voltage $V_{COM}$ is the same as the profile (C), almost 0 V of voltage is supplied as the difference to the liquid crystal layer 5.

The reference voltage $V_{REF}$ and the ramp wave $V_{RAMP}$ are not necessarily successive amplitude signals. Instead, as shown in FIG. 12B, the reference voltage $V_{REF}$ and ramp wave $V_{RAMP}$ may be intermittently (at intervals of approximately 5 ms to 1 s) supplied as shown in FIG. 12B. In other words, at timing corresponding to the holding characteristics of the liquid crystal layer 5, the reference voltage $V_{REF}$ and the ramp wave $V_{RAM}$ are refreshed.

In addition, as shown in FIG. 12A, until an AC voltage with a predetermined level is supplied to the liquid crystal layer, a voltage exceeding the predetermined level may be supplied. To prevent this situation, the profile of the reference voltage $V_{REF}$ may have an offset component for compensating a voltage level that exceeds the predetermined level.

For example, as shown with a profile (C') of FIG. 12C, when the profile of the reference voltage $V_{REF}$ has an offset component for canceling the voltage that is higher than the predetermined level, the effective voltage or average voltage supplied to the liquid crystal layer can be optimized.

The circuit may be driven with a ramp wave $V_{RAMP}$ that periodically increases rather than decreases, when employed TFT 51*b* is a p-ch TFT. For example, when the transistor 51 is composed of a p-channel thin film transistor, a waveform that periodically increases can be used as the ramp wave $V_{RAMP}$.

As shown with the profile (f) of FIG. 2, the waveform of the ramp wave $V_{RAMP}$ may be stair-step shaped. In this case, the fluctuation of characteristics of the devices that compose the pixel circuit and the influence of noise can be suppressed to some extent.

In the above description, with the ramp wave $V_{RAMP}$, the method for generating an AC voltage corresponding to the display signal in a pixel was explained. However, the profile of the ramp wave $V_{RAMP}$ may be a saw tooth wave, a rectangular wave, a sine wave, and a waveform considering transmissivity of liquid crystal material and γ compensation value may be used.

Figure 11F:
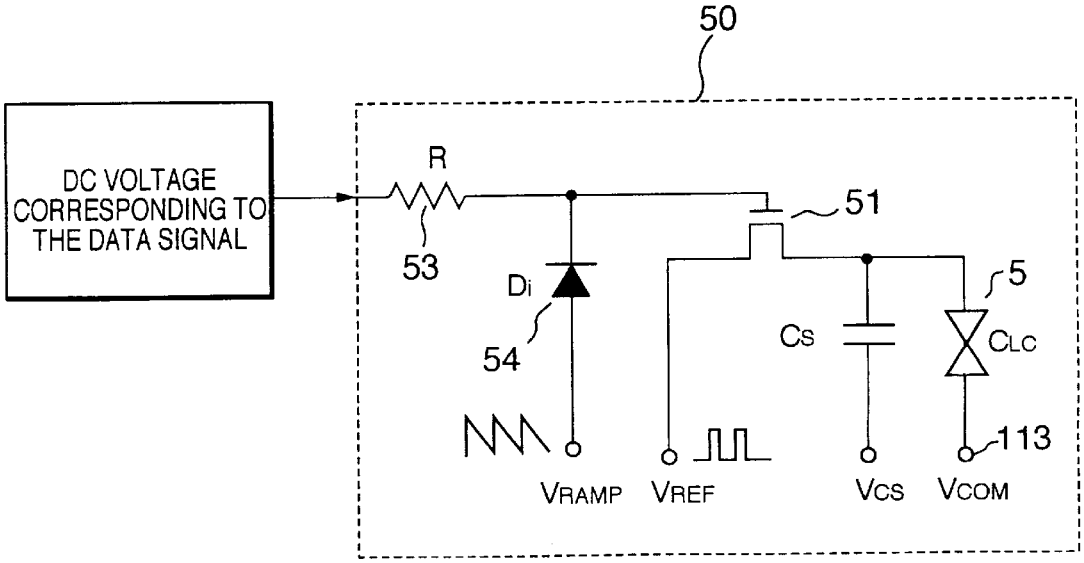
Figure 12D:
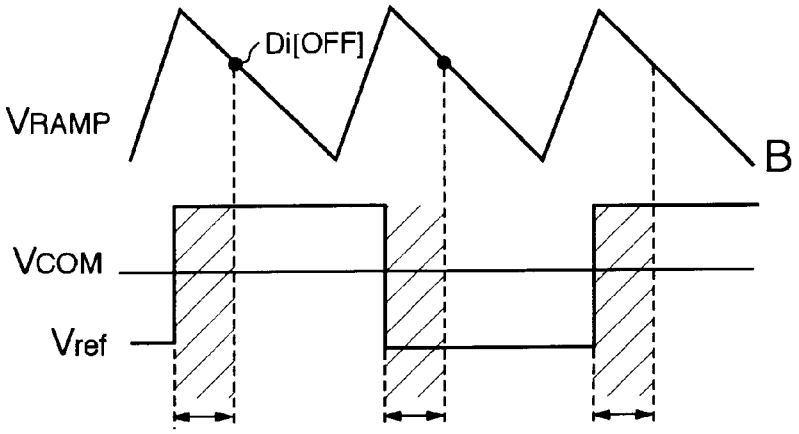
FIG. 12D showing another profile of the reference voltage $V_{REF}$ for explaining a driving operation of the pixel of the liquid crystal display device according to the present invention shown in FIG. 11F.

FIG. 11F is a schematic diagram in the case that a square wave is used as the reference voltage $V_{REF}$. As shown in FIG. 12D, by modulating a supply time $T_A$ of the reference voltage $V_{REF}$ supplied to the liquid crystal layer 5 through the source and drain of the transistor 51, the effective value or average value of the AC voltage supplied to the liquid crystal layer 5 can be controlled. Since the supply time $T_A$ is equivalent to the time of which the transistor 51 is turned on, as with the above description, the effective value or average value can be controlled with the DC voltage V1 corresponding to the signal voltage. This driving method is especially suitable when a liquid crystal material corresponding to the effective value of the AC voltage is used.

The circuit 50 that generates an AC voltage corresponding to a display signal in a pixel can be applied for the liquid crystal display apparatus according to the present invention as shown in FIGS. 1, 6, 7, 8, and 9. After a display signal is sampled to a pixel, it is stored in the memory. For example, after a display signal is sampled to a pixel, the signal is temporarily stored in a memory. An analog DC voltage corresponding to the display signal stored in the memory can be input to the circuit 50. Alternatively, the sampled analog signal may be input to the circuit 50 through the analog buffer 104.

The entire disclosure of Japanese Patent Application No. Hei 8(1996)-231024 filed on Aug. 30, 1996 including specification, claims, drawings and summary are incorporated herein by reference in its entirety.

What is claimed is:

1. An active matrix type liquid crystal display device having pixels formed in a matrix array, comprising:

at least a liquid crystal layer disposed so as to interact with first electrodes and at least a second electrode, and the first electrodes being formed in respective pixels;

selecting means for selecting a data signal, and the selecting means being formed in respective pixels;

storing means for storing the data signal selected by the selecting means and for outputting an analog signal corresponding to the data signal, the storing means being formed in respective pixels; and voltage supplying means for supplying an AC voltage corresponding to the analog signal to the liquid crystal layer, the voltage supplying means being formed in respective pixels, wherein the voltage supplying means has a first voltage supplying means for supplying a first AC voltage and a second AC voltage with a phase difference against the first AC voltage corresponding to the analog signal, wherein a voltage difference between the first AC voltage and the second AC voltage is applied to the liquid crystal layer and wherein the first AC voltage and the second AC voltage have almost identical waveforms.

2. The active matrix type liquid crystal display device as set forth in claim 1, at least one of the first AC voltage and the second AC voltage having a square-shaped waveform.

3. The active matrix type liquid crystal display device as set forth in claim 1, at least one of the first AC voltage and the second AC voltage having a ramp-shaped waveform.

4. The active matrix type liquid crystal display device as set forth in claim 1, at least one of the first AC voltage and the second AC voltage having a stair-step shaped waveform.

5. An active matrix type liquid crystal display device having pixels formed in a matrix array, comprising:

at least a liquid crystal layer disposed so as to interact with first electrodes and at least a second electrode, and the first electrodes being formed in respective pixels;

selecting means for selecting a data signal, and the selecting means being formed in respective pixels;

storing means for storing the data signal selected by the selecting means and for outputting an analog signal corresponding to the data signal, the storing means being formed in respective pixels; and voltage supplying means for supplying an AC voltage corresponding to the analog signal to the liquid crystal layer, the voltage supplying means being formed in respective pixels, wherein the voltage supplying means includes:

first voltage supplying for supplying first AC voltage to the first electrode; and second voltage supplying means for supplying a second AC voltage with a phase difference against the first AC voltage corresponding to the analog signal to the second electrodes and wherein the first AC voltage and the second AC voltage have almost identical waveforms.

6. The active matrix type liquid crystal display device as set forth in claim 5, wherein the storing means stores the data signal selected by the selecting means at a first timing and outputs the data signal to the second voltage supplying means at a second timing with a predetermined delay against the first timing.

7. The active matrix type liquid crystal display device as set forth in claim 5, further comprising:

means for supplying a reference voltage that periodically varies, wherein the second voltage supplying means compares the analog signal with the reference voltage and supplies a second AC voltage to the second electrode, the second AC voltage having a phase difference corresponding to time after the beginning of the period of the variation of the reference voltage until the analog signal accords with the reference voltage.

* * * * *